US010935192B2

(12) United States Patent
Han

(10) Patent No.: US 10,935,192 B2
(45) Date of Patent: Mar. 2, 2021

(54) TUBE-SHAPED LED LIGHTING DEVICE

(71) Applicant: Seoul Viosys Co., Ltd., Ansan-si (KR)

(72) Inventor: Kyu Won Han, Ansan-si (KR)

(73) Assignee: Seoul Viosys Co., Ltd., Ansan-si (KR)

( * ) Notice: Subject to any disclaimer, the term of this patent is extended or adjusted under 35 U.S.C. 154(b) by 59 days.

(21) Appl. No.: 16/253,080

(22) Filed: Jan. 21, 2019

(65) Prior Publication Data

US 2019/0234564 A1 Aug. 1, 2019

Related U.S. Application Data

(63) Continuation of application No. PCT/KR2017/007897, filed on Jul. 21, 2017.

(30) Foreign Application Priority Data

Jul. 22, 2016 (KR) ..... 10-2016-0093511
Jul. 26, 2016 (KR) ..... 10-2016-0094503
Jul. 20, 2017 (KR) ..... 10-2017-0092219

(51) Int. Cl.
*F21K 9/278* (2016.01)
*F21V 29/74* (2015.01)
(Continued)

(52) U.S. Cl.
CPC ..... *F21K 9/278* (2016.08); *F21K 9/27* (2016.08); *F21K 9/272* (2016.08); *F21K 9/65* (2016.08);
(Continued)

(58) Field of Classification Search
CPC . F21K 29/74; F21K 9/27; F21K 9/272; F21K 9/278; F21K 9/65; F21V 29/74; F21V 3/061; F21Y 2103/10
See application file for complete search history.

(56) References Cited

U.S. PATENT DOCUMENTS

2003/0114606 A1* 6/2003 Taniguchi ..... C08K 5/5399 525/523
2008/0211429 A1* 9/2008 Saito ..... F21K 9/61 315/312
(Continued)

FOREIGN PATENT DOCUMENTS

CN 103727424 4/2014
CN 104033754 9/2014
(Continued)

OTHER PUBLICATIONS

Machine Translation of WO2014125765A1 (Year: 2014).*
(Continued)

*Primary Examiner* — Leah Simone Macchiarolo
(74) *Attorney, Agent, or Firm* — H.C. Park & Associates, PLC

(57) ABSTRACT

A tube-shaped LED lighting device including: a substrate; a light emitting device mounted on the substrate; a heat sink having one surface on which the substrate is seated, and opposite side surfaces including a groove portion; a cover to receive the heat sink, the substrate, and the light emitting device therein, and including an overhang protruding from an inner wall of the cover to be inserted into the groove portion; and a base coupled to an end of the cover, in which the heat sink includes a substrate holding portion surrounding opposite sides of the substrate.

18 Claims, 23 Drawing Sheets

(51) Int. Cl.

| | |
|---|---|
| ***F21K 9/65*** | (2016.01) |
| ***F21V 29/76*** | (2015.01) |
| ***F21K 9/272*** | (2016.01) |
| ***F21K 9/27*** | (2016.01) |
| ***F21V 23/06*** | (2006.01) |
| ***F21V 19/00*** | (2006.01) |
| ***F21V 3/06*** | (2018.01) |
| ***F21V 23/02*** | (2006.01) |
| *F21Y 103/10* | (2016.01) |
| *F21Y 115/10* | (2016.01) |

(52) U.S. Cl.
CPC ..... *F21V 3/061* (2018.02); *F21V 19/0045* (2013.01); *F21V 23/023* (2013.01); *F21V 23/06* (2013.01); *F21V 29/74* (2015.01); *F21V 29/763* (2015.01); *F21Y 2103/10* (2016.08); *F21Y 2115/10* (2016.08)

(56) References Cited

U.S. PATENT DOCUMENTS

| | | | | |
|---|---|---|---|---|
| 2009/0219713 | A1* | 9/2009 | Siemiet | F21V 29/76 362/218 |
| 2010/0102729 | A1* | 4/2010 | Katzir | F21V 23/006 315/113 |
| 2010/0220469 | A1* | 9/2010 | Ivey | F21V 29/507 362/218 |
| 2011/0309745 | A1* | 12/2011 | Westermarck | F21V 29/74 315/51 |
| 2015/0049475 | A1* | 2/2015 | Pan | F21K 9/272 362/218 |
| 2015/0292688 | A1* | 10/2015 | Dahlen | F21K 9/66 362/217.02 |
| 2019/0145611 | A1* | 5/2019 | May | F21V 21/02 362/147 |

FOREIGN PATENT DOCUMENTS

| | | | | |
|---|---|---|---|---|
| CN | 104712939 | | 6/2015 | |
| EP | 2525131 | | 11/2012 | |
| KR | 20-0435173 | | 1/2007 | |
| KR | 10-2011-0089613 | | 8/2011 | |
| KR | 10-2015-0096225 | | 8/2015 | |
| TW | 201520465 | | 6/2015 | |
| WO | 2010-110514 | | 9/2010 | |
| WO | 2011-074884 | | 6/2011 | |
| WO | WO-2014125765 | A1 * | 8/2014 | F21V 29/83 |

OTHER PUBLICATIONS

Machine Translation of CN104033754A (Year: 2014).*
Partial Supplementary European Search Report dated Feb. 26, 2020, in European Patent Application No. 17831390.4.
International Search Report dated Nov. 2, 2017 for International Application No. PCT/KR2017/007897 (with English Translation).
Textbook "Magic New Material", Minhua Jiang, Shandong Science and Technology Press, p. 72, Publication Date: Oct. 31, 2013.
Textbook "Qicai Nichang New Light Source LED and Modern Life", Deyou Yu, et al., Guangdong Science and Technology Press, pp. 89-90, Publication Date: May 31, 2011.

* cited by examiner

TUBE-SHAPED LED LIGHTING DEVICE

CROSS-REFERENCE TO RELATED APPLICATIONS

This application is a Continuation of International Patent Application No. PCT/KR2017/007897, filed on Jul. 21, 2017, and claims priority from and the benefit of Korean Patent Application No. 10-2016-0093511, filed on Jul. 22, 2017, Korean Patent Application No. 10-2016-0094503, filed on Jul. 26, 2016, and Korean Patent Application No. 10-2017-0092219, filed on Jul. 20, 2017, which are hereby incorporated by reference for all purposes as if fully set forth herein.

BACKGROUND

Field

Exemplary embodiments of the invention relate to a tube-shaped LED lighting device.

Discussion of the Background

A light emitting diode (LED) generally refers to a semiconductor device configured to emit light in response to an applied electric current. As a solid device having various advantages, such as environmental friendliness due to no use of mercury, long lifespan, and low power consumption, the LED has gained attention as a new light source.

Various lighting devices using an LED as a light source have been developed. For example, an LED lighting device including a light bulb type power connector that is capable of being mounted on a receptacle of a light bulb has gained attractions in the art.

LEDs generally have a problem of heat generation during operation. Inefficient heat dissipation of the LEDs can cause deterioration in its lifespan and intensity of illumination. An upper temperature limit for an efficient turn-on of the LEDs may be about 60° C., and the performance of an LED lighting device is known to be directly related to heat dissipation.

Ultraviolet (UV) light generally refers to light in the wavelength band of 100 nm to 400 nm and has higher energy than visible light. UV light emitted from the sun is divided into ultraviolet-A, ultraviolet-B, and ultraviolet-C, and most UV-C is known to be absorbed by the ozone layer while UV-A and UV-B reach the ground.

UV light can be utilized in various fields. For example, a UV lamp includes a lamp tube and a lighting device disposed in the lamp tube to emit UV light. The lamp tube is required to have high transmittance with respect to UV light and not to be deformed when exposed to UV light for a long period of time.

The above information disclosed in this Background section is only for understanding of the background of the inventive concepts, and, therefore, it may contain information that does not constitute prior art

SUMMARY

Exemplary embodiments of the invention provide a tube-shaped LED lighting device with improved heat dissipation.

Exemplary embodiments of the invention also provide a tube-shaped LED lighting device free from or minimize the usage of wire bonding to prevent failure from open circuit and short circuit.

Exemplary embodiments of the invention further provide a UV lamp having improved performance and reliability and a method of manufacturing the same.

In accordance with one aspect of the present disclosure, a tube-shaped LED lighting device includes: a substrate; a light emitting device mounted on the substrate; a heat sink having one surface on which the substrate is seated, and opposing side surfaces including a groove portion; a cover to receive the heat sink, the substrate and the light emitting device therein and including an overhang protruding from an inner wall thereof to be inserted into the groove portion; and a base coupled to an end of the cover, in which the heat sink includes a substrate holding portion surrounding opposite sides of the substrate.

In accordance with another aspect of the present disclosure, a tube-shaped LED lighting device includes: a substrate; a light emitting device mounted on the substrate; a heat sink having one surface on which the substrate is seated, the heat sing including a groove portion formed on opposite side surfaces thereof; a cover to receive the heat sink, the substrate and, the light emitting device therein, and including an overhang protruding from an inner wall thereof to be inserted into the groove portion; and a base coupled to an end of the cover, in which the substrate has one end placed inside the base after passing through the base.

In accordance with a further aspect of the present disclosure, a UV lamp includes: a lamp tube including an upper cover and a lower cover integrally formed with the upper cover; a printed circuit board secured inside the lamp tube; and at least one UV light emitting device disposed on the printed circuit board to face the upper cover and to be operated under control of the printed circuit board, in which the at least one UV light emitting device is configured to emit UV light having a wavelength of 360 nm or more toward the upper cover, the upper cover includes polymethyl methacrylate.

In one exemplary embodiment, the UV lamp may further include a flame retardant layer disposed between the printed circuit board and the upper cover.

In one exemplary embodiment, the UV lamp may further include a heat sink secured inside the lamp tube and configured to dissipate heat generated from the printed circuit board. The heat sink may be formed at an upper portion thereof with a groove, the printed circuit board and the flame retardant layer may be placed in the groove, and the flame retardant layer may cover the printed circuit board.

In one exemplary embodiment, the UV lamp may further include a heat sink secured inside the lamp tube and adapted to dissipate heat generated from the printed circuit board. The heat sink may be formed at an upper side thereof with a groove, the printed circuit board may be placed in the groove, and the flame retardant layer may cover the upper side of the heat sink and the printed circuit board.

In one exemplary embodiment, the UV lamp may further include: a heat sink configured to support the printed circuit board and to dissipate heat generated from the printed circuit board; and a power supply disposed between the heat sink and the lower cover and adapted to convert external AC power into DC power and to supply the converted DC power to the printed circuit board. The lower cover may include polymethyl methacrylate and be opaque.

In one exemplary embodiment, the UV lamp may further include a base secured to a distal end of the lamp tube. The at least one UV light emitting device may be disposed on the printed circuit board such that UV light is emitted therefrom in a certain beam orientation range and the base is disposed outside the certain beam orientation range.

In one exemplary embodiment, the UV lamp may further include a base secured to a distal end of the lamp tube. Here, the base may include a UV stabilizer.

In accordance with yet another aspect of the present disclosure, a UV lamp includes: a lamp tube including an upper cover and a lower cover integrally formed with the upper cover; a printed circuit board secured inside the lamp tube; at least one UV light emitting device disposed on the printed circuit board to face the upper cover and configured to emit UV light toward the upper cover under control of the printed circuit board; and a flame retardant layer disposed between the printed circuit board and the upper cover. The upper cover may include polymethyl methacrylate.

In one exemplary embodiment, the at least one UV light emitting device may emit UV light having a wavelength of 360 nm or more.

In one exemplary embodiment, the lower cover may include polymethyl methacrylate and may be opaque.

In accordance with yet another aspect of the present disclosure, a method of manufacturing a UV lamp is provided. The method of manufacturing a UV lamp includes: melting a first raw material and a second raw material to form a first molten material and a second molten material; supplying the first molten material and the second molten material to one mold to integrally form an upper cover and a lower cover; cooling the upper cover and the lower cover; placing a printed circuit board and at least one UV light emitting device operated under control of the printed circuit board inside the upper cover and the lower cover. The at least one UV light emitting device may be disposed to face the upper cover; the at least one UV light emitting device emits UV light having a wavelength of 360 nm toward the upper cover; and the upper cover includes polymethyl methacrylatepolymethyl methacrylate.

In accordance with yet another aspect of the present disclosure, a UV lamp includes: a lamp tube including an upper cover and a lower cover integrally formed with the upper cover; a printed circuit board secured inside the lamp tube; at least one UV light emitting device disposed on the printed circuit board to face the upper cover and configured to emit UV light toward the upper cover under control of the printed circuit board; and a flame retardant layer disposed between the printed circuit board and the upper cover and surrounding at least part of an outer surface of the lamp tube.

In one exemplary embodiment, the upper cover may include polymethyl methacrylatepolymethyl methacrylate or quartz.

In one exemplary embodiment, the lower cover may include polymethyl methacrylatepolymethyl methacrylate or quartz and may be opaque.

In one exemplary embodiment, the flame retardant layer may be attached to at least part of an inner surface of the lamp tube.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the inventive concepts.

DETAILED DESCRIPTION

Figure 1:
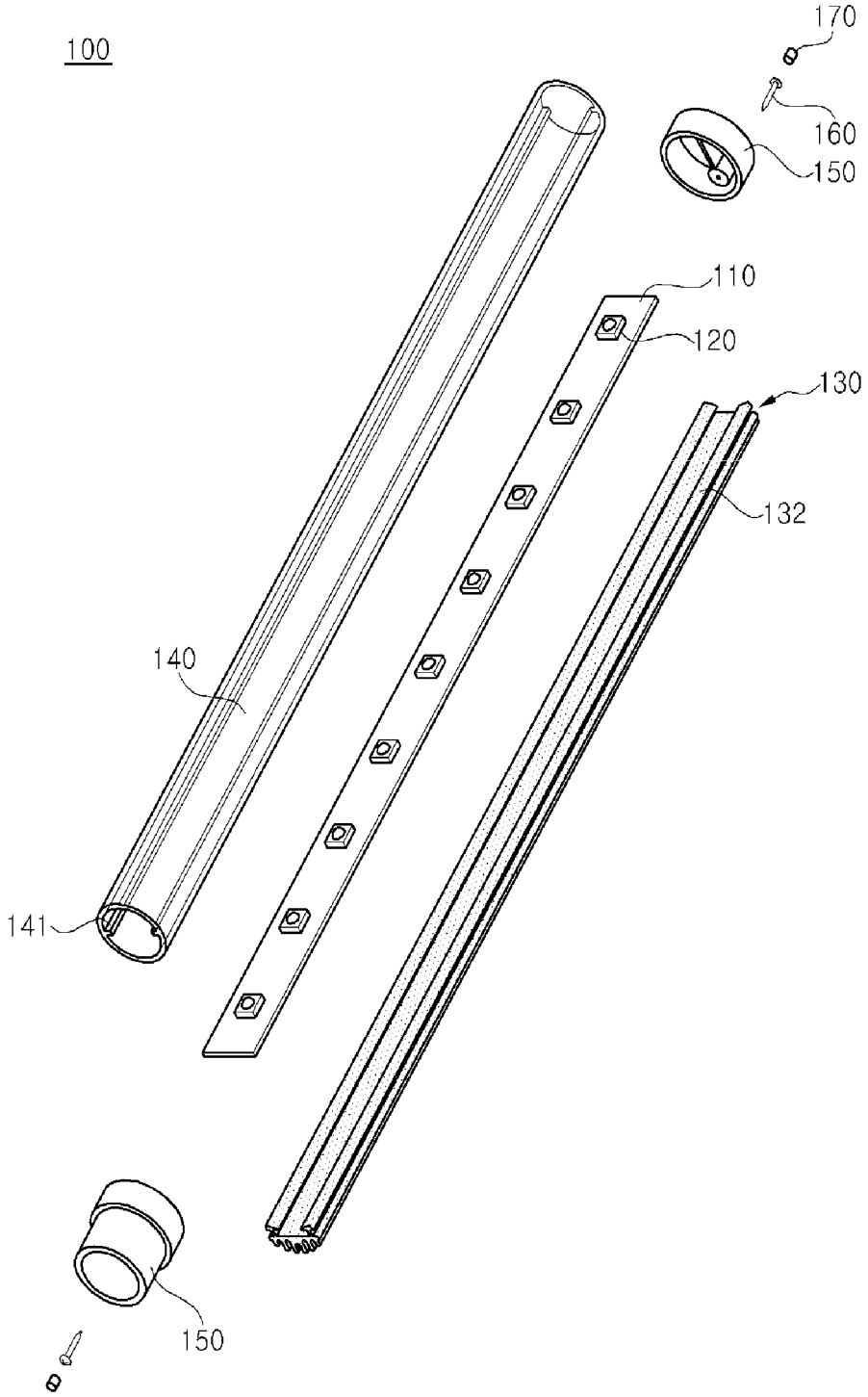
FIG. 1 is an exploded view of a tube-shaped LED lighting device according to a first exemplary embodiment.

In the following description, for the purposes of explanation, numerous specific details are set forth in order to provide a thorough understanding of various exemplary embodiments or implementations of implementations of the invention. As used herein "embodiments" and "implementations" are interchangeable words that are non-limiting examples of devices or methods employing one or more of the inventive concepts disclosed herein. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments. Further, various exemplary embodiments may be different, but do not have to be exclusive. For example, specific shapes, configurations, and characteristics of an exemplary embodiment may be used or implemented in another exemplary embodiment without departing from the scope of the inventive concepts.

Unless otherwise specified, the illustrated exemplary embodiments are to be understood as providing exemplary features of varying detail of some ways in which the inventive concepts may be implemented in practice. Therefore, unless otherwise specified, the features, components, modules, layers, films, panels, regions, and/or aspects, etc. (hereinafter individually or collectively referred to as "elements"), of the various embodiments may be otherwise combined, separated, interchanged, and/or rearranged without departing from the scope of the inventive concepts.

The use of cross-hatching and/or shading in the accompanying drawings is generally provided to clarify boundaries between adjacent elements. As such, neither the presence nor the absence of cross-hatching or shading conveys or indicates any preference or requirement for particular materials, material properties, dimensions, proportions, commonalities between illustrated elements, and/or any other characteristic, attribute, property, etc., of the elements, unless specified. Further, in the accompanying drawings, the size and relative sizes of elements may be exaggerated for clarity and/or descriptive purposes. When an exemplary embodiment may be implemented differently, a specific process order may be performed differently from the described order. For example, two consecutively described processes may be performed substantially at the same time or performed in an order opposite to the described order. Also, like reference numerals denote like elements.

When an element, such as a layer, is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. To this end, the term "connected" may refer to physical, electrical, and/or fluid connection, with or without intervening elements. Further, the D1-axis, the D2-axis, and the D3-axis are not limited to three axes of a rectangular coordinate system, such as the x, y, and z-axes, and may be interpreted in a broader sense. For example, the D1-axis, the D2-axis, and the D3-axis may be perpendicular to one another, or may represent different directions that are not perpendicular to one another. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various types of elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one elements relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

Various exemplary embodiments are described herein with reference to sectional and/or exploded illustrations that are schematic illustrations of idealized exemplary embodiments and/or intermediate structures. As such, variations from the shapes of the illustrations as a result, for example, of manufacturing techniques and/or tolerances, are to be expected. Thus, exemplary embodiments disclosed herein should not necessarily be construed as limited to the particular illustrated shapes of regions, but are to include deviations in shapes that result from, for instance, manufacturing. In this manner, regions illustrated in the drawings may be schematic in nature and the shapes of these regions may not reflect actual shapes of regions of a device and, as such, are not necessarily intended to be limiting.

As is customary in the field, some exemplary embodiments are described and illustrated in the accompanying drawings in terms of functional blocks, units, and/or modules, such as control boards and control units. Those skilled in the art will appreciate that these blocks, units, and/or modules are physically implemented by electronic (or optical) circuits, such as logic circuits, discrete components, microprocessors, hard-wired circuits, memory elements, wiring connections, and the like, which may be formed using semiconductor-based fabrication techniques or other manufacturing technologies. In the case of the blocks, units, and/or modules being implemented by microprocessors or other similar hardware, they may be programmed and controlled using software (e.g., microcode) to perform various functions discussed herein and may optionally be driven by firmware and/or software. It is also contemplated that each block, unit, and/or module may be implemented by dedicated hardware, or as a combination of dedicated hardware to perform some functions and a processor (e.g., one or more programmed microprocessors and associated circuitry) to perform other functions. Also, each block, unit, and/or module of some exemplary embodiments may be physically separated into two or more interacting and discrete blocks, units, and/or modules without departing from the scope of the inventive concepts. Further, the blocks, units, and/or modules of some exemplary embodiments may be physically combined into more complex blocks, units, and/or modules without departing from the scope of the inventive concepts.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and should not be interpreted in an idealized or overly formal sense, unless expressly so defined herein.

A tube-shaped LED lighting device according to one exemplary embodiment includes: a substrate, a light emitting device mounted on the substrate, a heat sink having one surface on which the substrate is seated, the heat sink including a groove portion formed on opposite side surfaces thereof, a cover receiving the heat sink, the substrate and the light emitting device therein, the cover including an overhang protruding from an inner wall thereof to be inserted into the groove portion, and a base coupled to each of opposite ends of the cover. The opposite side surfaces of the heat sink may have a shape corresponding to an inner wall of the cover. For example, the inner wall of the cover may include a curved surface. In addition, the opposite side surfaces of the heat sink may include curved surfaces. This structure can reduce or minimize a distance between the cover and the heat sink. Accordingly, the heat sink may transfer heat from the light emitting device to the cover, thereby improving heat dissipation of the tube-shaped LED lighting device.

The heat sink may further include a substrate holding portion surrounding opposite sides of the substrate. One surface of the substrate holding portion may have a gradually increasing height from an inner side of the heat sink, on which the substrate is seated, toward an outer side thereof. More particularly, the one surface of the substrate holding portion may be formed to have a certain angle. This structure can reduce or prevent light emitted from the light emitting device from colliding with the substrate holding portion, thereby improving luminous efficacy of the tube-shaped LED lighting device.

The heat sink may further include a heat dissipation fin formed on the other surface thereof facing the one surface thereof. The heat dissipation fin may increase a contact area between the heat sink and air, thereby further improving heat dissipation of the tube-shaped LED lighting device.

The cover may be formed of a transparent material. Alternatively, some portion of the cover may be formed of a transparent material and the other portion of the cover may be formed of a non-transparent material. At least part of the cover may be formed of pure polymethyl methacrylate (PMMA). For example, a portion of the cover through which light emitted from the light emitting device passes may be formed of pure PMMA. As such, a light transmitting portion of the cover may be formed of pure PMMA to improve light transmittance.

The cover may include at least one of a transparent region, a translucent region, and a colored region.

The substrate may have one end placed inside the base after passing through the base. In addition, power pads may be formed on the one end of the substrate placed inside the base. The power pads are connected to an external power device. Due to the substrate and the power pads with this structure, the LED lighting device may omit base heat dissipation fin and a wire for electric connection between the external power device and the substrate in the art. Thus, it is possible to omit a process for inserting the base heat dissipation fin into the base and a wire bonding process. In addition, the LED lighting device can reduce or prevent open circuit and short circuit due to failure of the base heat dissipation fin and the wire.

The power pads may be formed on one surface of the one end of the substrate. Alternatively, the power pads may be formed on one surface and the other surface of the one end of the substrate, respectively. Alternatively, the power pads may be formed on opposite side surfaces of the one end of the substrate, respectively.

The tube-shaped LED lighting device may further include a connector having one end protruding to outside of the base and the other end contacting the power pads formed on the one end of the substrate.

A tube-shaped LED lighting device according to another exemplary embodiment of the present disclosure includes: a substrate, a light emitting device mounted on the substrate, a heat sink having one surface on which the substrate is seated, the heat sink including a groove portion formed on opposite side surfaces thereof, a cover receiving the heat sink, the substrate and the light emitting device therein, the cover including an overhang protruding from an inner wall thereof to be inserted into the groove portion, and a base coupled to each of opposite ends of the cover, in which the substrate has one end placed inside the base after passing through the base.

Figure 2:
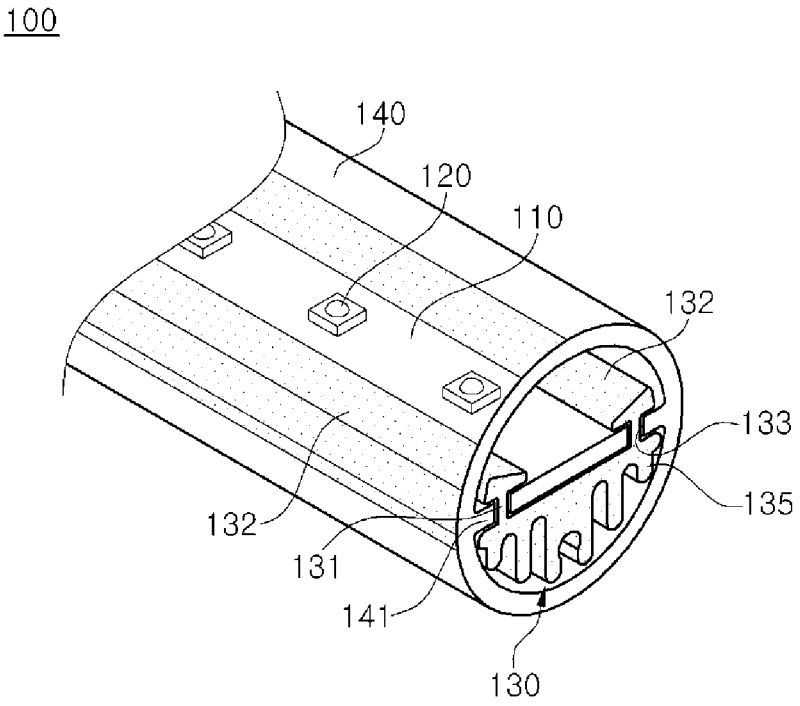
FIG. 2 is a sectional view of the tube-shaped LED lighting device of FIG. 1 according to an exemplary embodiment.
Figure 3:
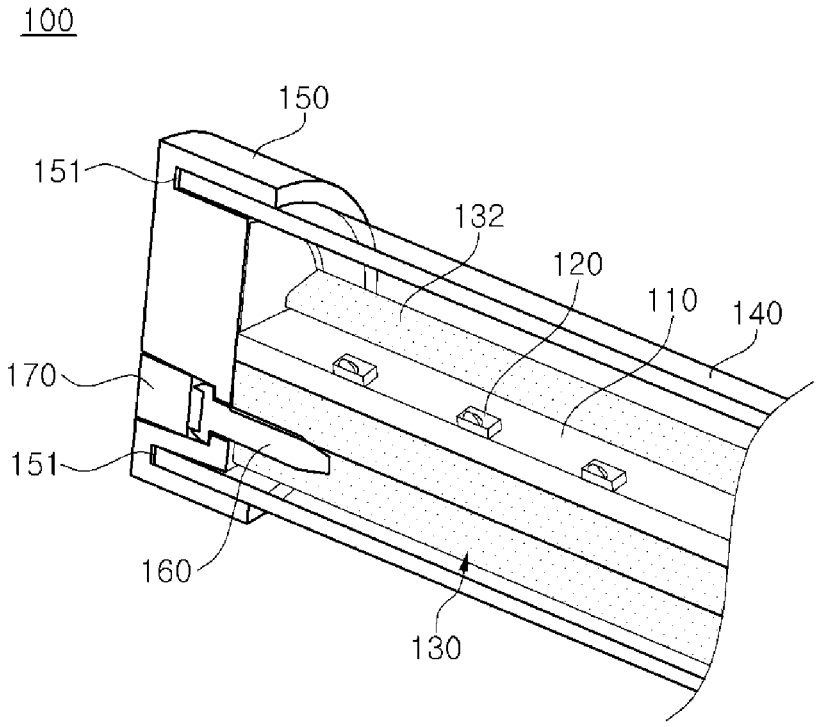
FIG. 3 is a cross-sectional view of the tube-shaped LED lighting device of FIG. 1 according to an first exemplary embodiment.

FIG. 1, FIG. 2, and FIG. 3 illustrate a tube-shaped LED lighting device according to a first exemplary embodiment. FIG. 1 is an exploded view of the tube-shaped LED lighting device according to the first exemplary embodiment. FIG. 2 is a sectional view of the tube-shaped LED lighting device of FIG. 1 according to an exemplary embodiment. FIG. 3 is a cross-sectional view of the tube-shaped LED lighting device of FIG. 1 according to an exemplary embodiment.

Referring to FIG. 1 to FIG. 3, the tube-shaped LED lighting device 100 according to the first exemplary embodiment includes a substrate 110, a light emitting device 120, a heat sink 130, a cover 140, and a base 150.

The substrate 110 may be a printed circuit board having conductive pattern formed thereon. The conductive pattern of the substrate 110 may be electrically connected to the light emitting device 120. According to the illustrated exemplary embodiment, the substrate 110 may have a substantially elongated shape corresponding to the shape of the cover 140.

The light emitting device 120 is mounted on one surface of the substrate 110. The light emitting device 120 may include an LED chip and a phosphor. The light emitting device 120 may generate various colors including white through combination of the LED chip and the phosphor. In FIG. 1 to FIG. 3, light emitting devices 120 are mounted on the substrate 110 in plural. However, the inventive concepts are not limited to a particular number of the light emitting device 120 mounted on the substrate 110.

The heat sink 130 may dissipate heat from the light emitting device 120 and the substrate 110. The heat sink 130 includes a substrate holding portion 131, groove portions 133, and a heat dissipation fin 135.

The substrate holding portion 131 is formed on one surface of the heat sink 130, on which the substrate 110 is seated, to surround opposite sides of the substrate 110 seated on the heat sink 130. The substrate holding portion 131 is elongated substantially in the longitudinal direction of the heat sink 130.

One surface 132 of the substrate holding portion 131 has a gradually increasing height from an inner side of the heat sink 130, on which the substrate 110 is seated, toward an outer side thereof. In particular, the one surface 132 of the substrate holding portion 131 is formed to have a predetermined angle. Here, the one surface 132 of the substrate holding portion 131 may be an upper surface of the heat sink 130 as shown in FIG. 1. The predetermined angle formed in the one surface 132 may prevent light emitted from the light emitting device 120 from being shielded by the substrate holding portion 131. In this manner, the substrate holding portion 131 secures high luminous efficacy of the tube-shaped LED lighting device 100.

The groove portion 133 is formed on opposite side surfaces of the heat sink 130. The groove portion 133 is concavely formed towards the center of the heat sink 130 and has a substantially groove shape. Here, the groove portion 133 may have a shape substantially corresponding to the shape of an overhang 141 of the cover 140. In addition, the groove portion 133 is placed to correspond to the overhang 141 of the cover 140. The overhang 141 of the cover 140 is inserted into the groove portion 133 such that the heat sink 130 is coupled to the cover 140.

The heat dissipation fin 135 is formed on a lower side of the heat sink 130. The heat sink 130 may have a plurality of heat dissipation fins 135. In this manner, the heat dissipation fin 135 increases a contact area between the heat sink 130 and air to improve heat dissipation performance of the heat sink 130. The inventive concepts are not limited to a particular structure and shape of the heat dissipation fin 135.

A side surface of the heat sink 130 is formed to correspond to an inner wall of the cover 140. Referring to FIG. 1 to FIG. 3, the cover 140 has substantially a cylindrical shape, and thus, has a curved inner wall. Accordingly, the side surface of the heat sink 130 has a curved shape. Such a structure can minimize a separation distance between the cover 140 and the heat sink 130. As the separation distance between the cover 140 and the heat sink 130 is decreased, the heat sink 130 can more easily dissipate heat from the light emitting device 120 and the substrate 110 through the cover 140. Accordingly, the tube-shaped LED lighting device 100 has an improved heat dissipation performance. Further, as shown in the drawings, the heat dissipation fin 135 has one end formed along the inner wall of the cover 140, thereby facilitating heat dissipation through the cover 140.

The cover 140 may surround the heat sink 130, the substrate 110, and the light emitting device 120. More particularly, the cover 140 receives the heat sink 130, the substrate 110, and the light emitting device 120 therein. The overhang 141 is formed on the cover 140. The overhang 141 protrudes from the inner wall of the cover 140 toward an interior space of the cover 140. The overhang 141 is inserted into the groove portion 133 formed on the opposite side surfaces of the heat sink 130.

The cover 140 is formed of a transparent resin or glass. For example, at least part of the cover 140 is formed of pure polymethyl methacrylate (PMMA). Here, the pure PMMA refers to PMMA free from an impurity or other components. That is, the entirety of the cover 140 may be formed of the pure PMMA. Alternatively, the cover 140 may be partially formed of the pure PMMA. Here, a portion of the cover 140 formed with the pure PMMA includes a region through which light emitted from the light emitting device 120 passes. PMMA has higher light transmittance with decreasing content of impurities or other components therein. Accordingly, a portion of the cover 140, through which light emitted from the light emitting device 120 passes, may be formed of a pure PMMA to improve light transmittance.

According to an exemplary embodiment, the cover 140 is transparent. However, the inventive concepts are not limited thereto, and in some exemplary embodiments, the cover 140 may be translucent or may have a color.

The base 150 is coupled to each of opposite end of the cover 140. For example, the base 150 is formed with cover insertion grooves 151 corresponding to the opposite ends of the cover 140. The opposite ends of the cover 140 are inserted into the cover insertion grooves 151 of the base 150, so that the cover 140 is coupled to the base 150. In addition, the cover 140 is secured to the bases 150 in a coupled state using screws 160. One end of the screw 160 is placed inside the base 150 and the other end of the screw 160 is placed inside the cover 140. Alternatively, the cover 140 may be secured to the bases 150 in a coupled state using adhesives. However, the inventive concepts are not limited to the usage of the screw or adhesives for securing the cover 140 to the bases 150, and the cover 140 may be secured to the bases 150 by any method known in the art.

A sealing member 170 is inserted into a space between the screw 160 and an outer surface of the tube-shaped LED lighting device 100. The sealing member 170 prevents moisture or the like from entering the tube-shaped LED lighting device 100. For example, the sealing member 170 may be formed of a resilient material and may be a rubber packing. In some exemplary embodiments, the sealing member 170 may be omitted.

Figure 4:
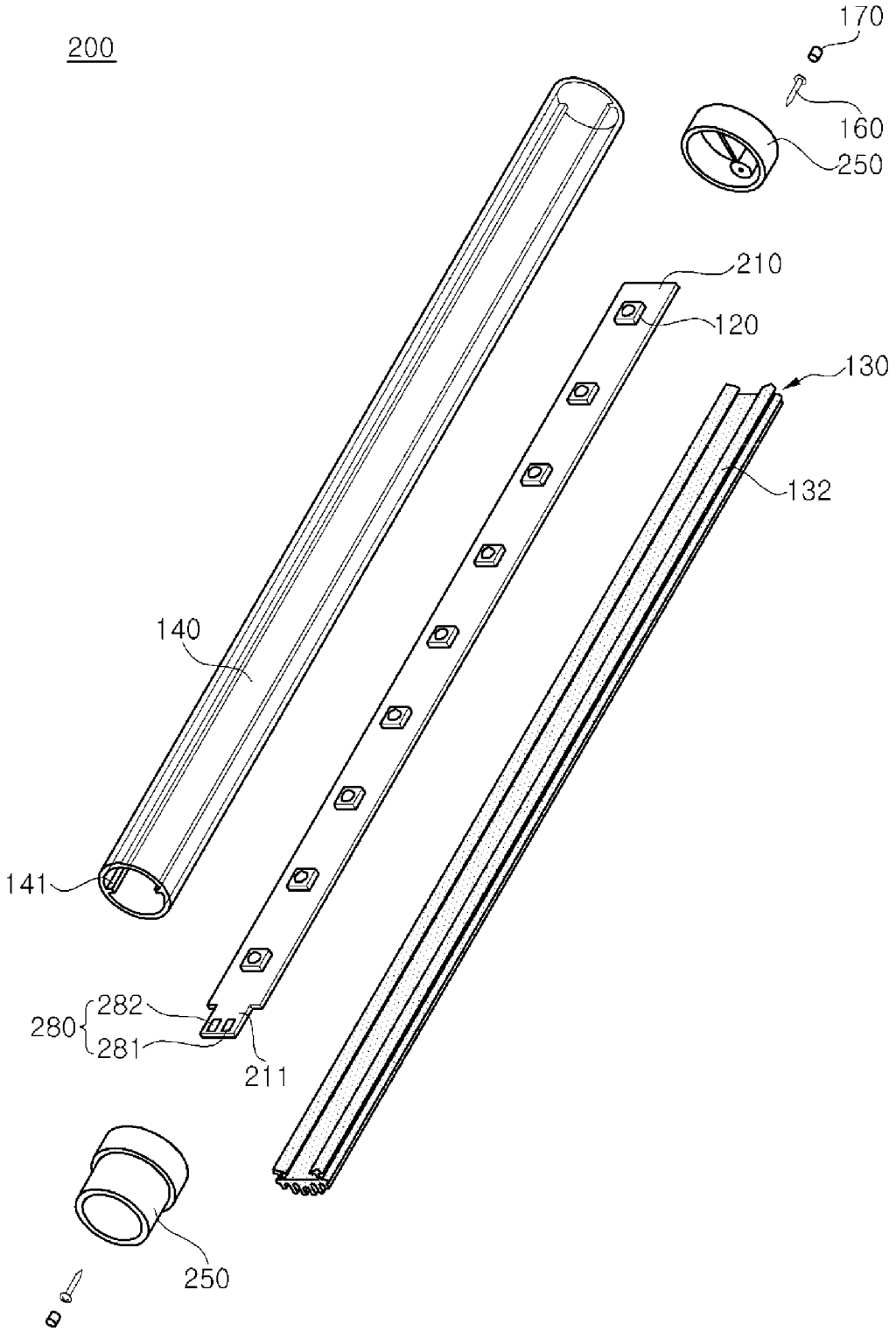
FIG. 4 is an exploded view of a tube-shaped LED lighting device according to a second exemplary embodiment.
Figure 5:
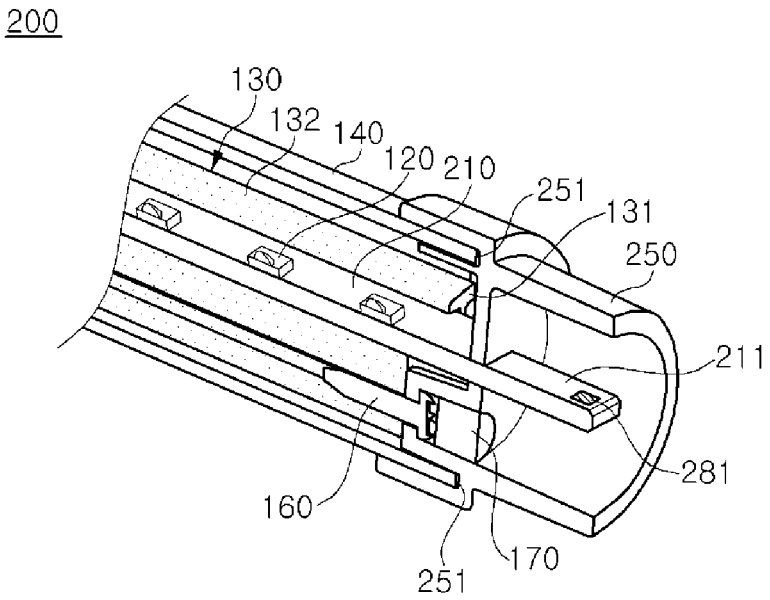
FIG. 5 is a cross-sectional view of the tube-shaped LED lighting device of FIG. 4 according to an exemplary embodiment.
Figure 6:
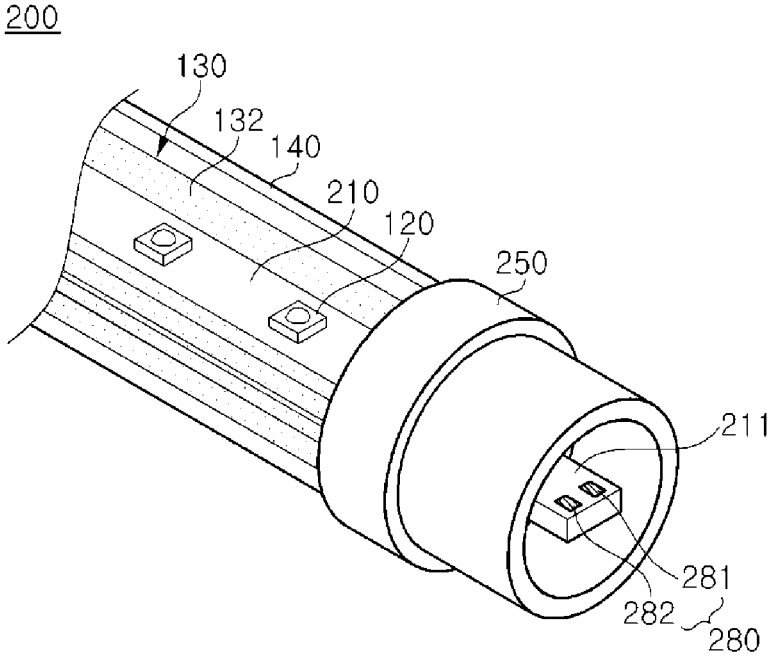
FIG. 6 is a sectional view of the tube-shaped LED lighting device of FIG. 4 according to an exemplary embodiment.

FIG. 4 to FIG. 6 illustrates a tube-shaped LED lighting device according to a second exemplary embodiment. FIG. 4 is an exploded view of a tube-shaped LED lighting device according to a second exemplary embodiment. FIG. 5 is a cross-sectional view of the tube-shaped LED lighting device of FIG. 4 according to an exemplary embodiment. FIG. 6 is a side sectional view of the tube-shaped LED lighting device of FIG. 4 according an exemplary embodiment.

The tube-shaped LED lighting device 200 according to the second exemplary embodiment may include substantially similar elements of the tube-shaped LED lighting device of FIG. 1, and thus, repeated descriptions of the substantially the same elements will be omitted to avoid redundancy Referring to FIG. 4 to FIG. 6, the tube-shaped LED lighting device 200 includes a substrate 210, a light emitting device 120, a heat sink 130, a cover 140, and a base 250.

The substrate 210, the light emitting device 120, and the heat sink 130 are disposed inside the cover 140. Here, the substrate 210 is secured to a substrate holding portion 131 formed on one surface of the heat sink 130. In addition, the light emitting device 120 is mounted on one surface of the substrate 210. Further, the base 250 is coupled to each opposite end of the cover 140. For example, the base 250 is formed with a cover insertion groove 251. The opposite ends of the cover 140 are inserted into the cover insertion grooves of the bases 250 such that the cover 140 is coupled to the base 250.

According to the illustrated exemplary embodiment, the substrate 210 has one end 211 penetrating the interior of the base 250. The base 250 coupled to the one end of the cover 140 is formed with an opening through which the one end 211 of the substrate 210 passes through and to place the one end 211 of the substrate 210 inside the base 250.

The one end 211 of the substrate 210 placed inside the base 250 is formed with a power pad 280. For example, the power pad 280 includes a first power pad 281 and a second power pad 282. Here, one of the first power pad 281 and the second power pad 282 is connected to a positive electrode of an external power device and the other power pad is connected to a negative electrode thereof. In FIG. 4 to FIG. 6, both the first power pad 281 and the second power pad 282 are formed on one surface of the substrate 210 to be parallel to each other.

The power pad 280 is electrically connected to the light emitting device 120 through conductive patterns formed on the substrate 210. In addition, the power pads 280 are connected to an external power device. In particular, the power pad 280 disposed inside the base 250 to electrically connect the external power device to the light emitting device 120. Connection between the other end of the cover 140 and the base 250 is substantially the same as shown in FIG. 3.

In general, electrical connection between the external power device and the substrate on which the light emitting device is mounted may require insertion of a base heat dissipation fin and a wire bonding process. However, such a process is performed in a narrow inner space of the base, which may cause a failure, such as electrical open circuit or short circuit.

However, according to the exemplary embodiments, the process of inserting the base heat dissipation fin and the wire bonding process may be omitted, thereby simplifying the manufacturing process. In addition, it is possible to prevent occurrence of a failure, such as electrical open circuit and short circuit.

Figure 7:
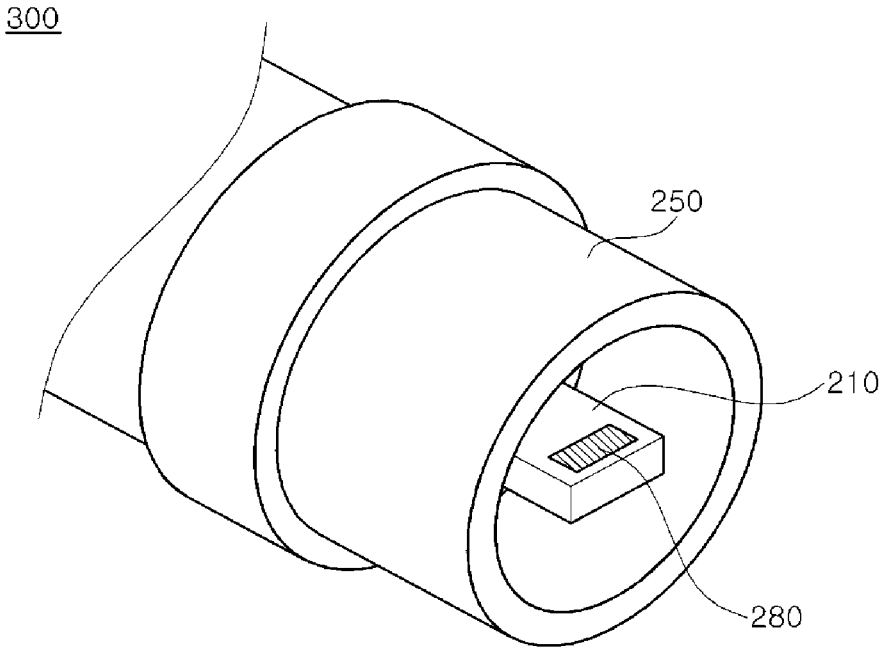
FIG. 7 is a sectional view of a tube-shaped LED lighting device according to a third exemplary embodiment.
Figure 8:
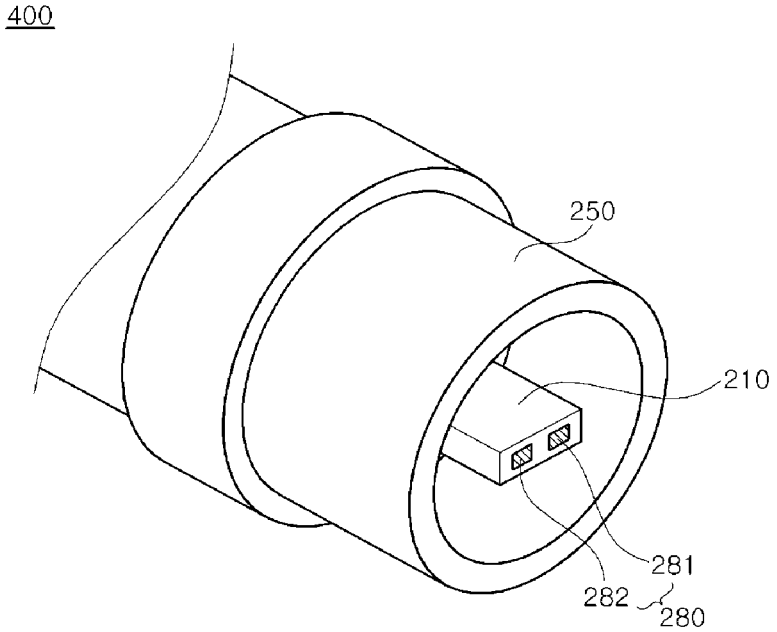
FIG. 8 is a sectional view of a tube-shaped LED lighting device according to a fourth exemplary embodiment.
Figure 9:
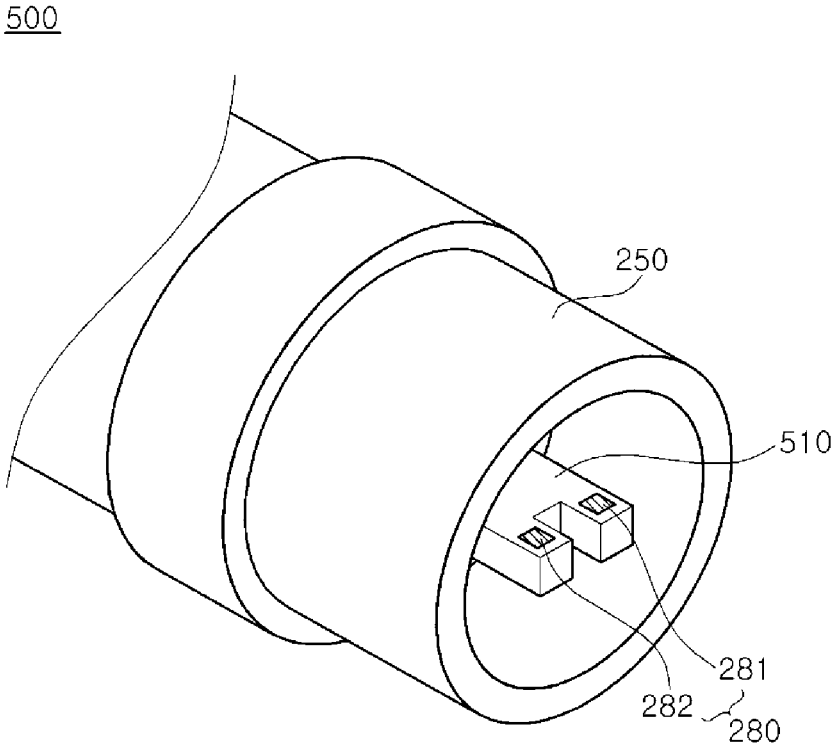
FIG. 9 is a sectional view of a tube-shaped LED lighting device according to a fifth exemplary embodiment.

FIG. 7 to FIG. 9 illustrate tube-shaped LED lighting devices according to third to fifth exemplary embodiments.

The following descriptions will be focused on different features of tube-shaped LED lighting devices 300, 400, 500 according to the third to fifth exemplary embodiments from the tube-shaped LED lighting device of FIG. 4. As such, repeated descriptions of the substantially the same elements will be omitted.

FIG. 7 to FIG. 9 show a portion of a substrate 210, 510 disposed inside the base 250. The illustrated portion of the substrate 210, 510 corresponds to the one end 211 of the substrate 210 of the tub-shaped LED lighting device according to the second exemplary embodiment described with reference to FIG. 4 to FIG. 6.

FIG. 7 is a sectional view of a tube-shaped LED lighting device according to a third exemplary embodiment.

Referring to FIG. 7, the tube-shaped LED lighting device 300 according to the third exemplary embodiment includes power pad 280 formed on one surface and the other surface of the substrate 210, respectively. For example, a first power pad is formed on one surface of the substrate 210 and a second power pad is formed on the other surface opposing the one surface of the substrate 210.

FIG. 8 is a sectional view of a tube-shaped LED lighting device according to the fourth exemplary embodiment.

Referring to FIG. 8, the tube-shaped LED lighting device 400 according to the fourth exemplary embodiment includes power pad 280 formed on one end of the substrate 210. More particularly, a first power pad 281 and a second power pad 282 are formed on one end of the substrate 210 to be parallel to each other.

FIG. 9 is a sectional view of a tube-shaped LED lighting device according to a fifth exemplary embodiment.

Referring to FIG. 9, the tube-shaped LED lighting device 500 according to the fifth exemplary embodiment includes a substrate 510 having a separation space formed at one end thereof. In particular, the one end of the substrate 510 is bifurcated into two portions. The tube-shaped LED device 500 includes power pad 280 formed on the bifurcated portions of the substrate 510, respectively. More specifically, as shown in FIG. 9, a first power pad 281 and a second power pad 282 are disposed on the bifurcated portions of the substrate 510, respectively.

Although FIG. 4 to FIG. 9 exemplarily show the substrate and the power pad according to some exemplary embodiments, however, the inventive concepts are not limited to the illustrated exemplary embodiments. For example, in some exemplary embodiments, one end of the substrate may be modified to facilitate connection to the external power device. Further, the location and structure of the power pad may be modified to facilitate connection to the external power device.

Figure 10:
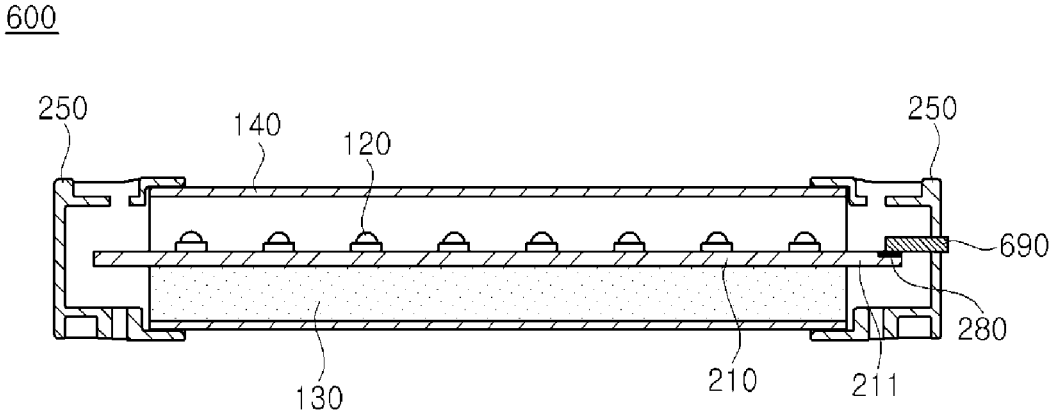
FIG. 10 is a cross-sectional view of a tube-shaped LED lighting device according to a sixth exemplary embodiment.
Figure 11:
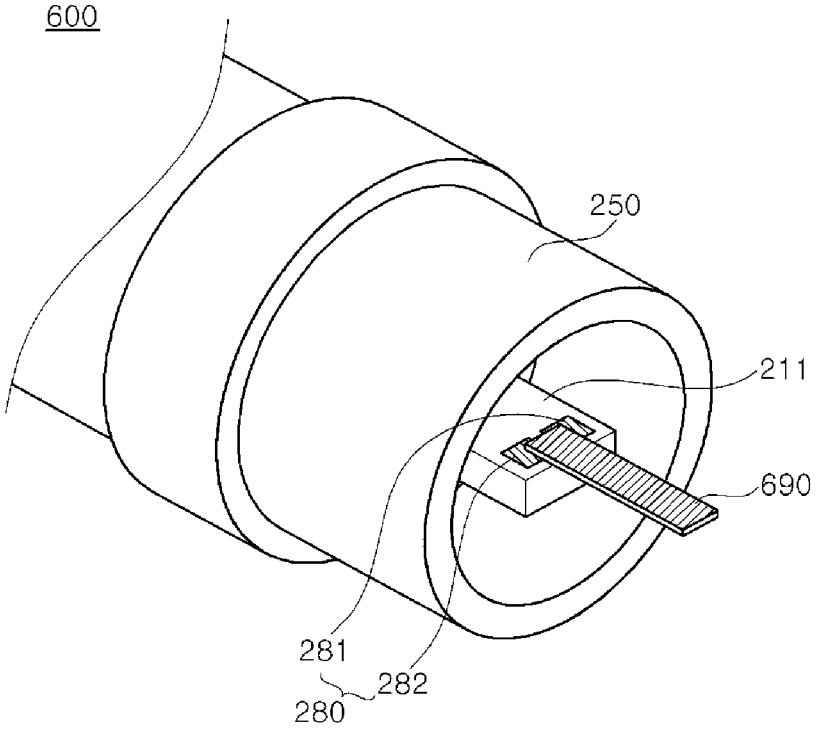
FIG. 11 is a sectional view of a tube-shaped LED lighting device of FIG. 10 according to an exemplary embodiment.

FIG. 10 and FIG. 11 illustrate a tube-shaped LED lighting device according to a sixth exemplary embodiment. FIG. 10 is a cross-sectional view of the tube-shaped LED lighting device according to the sixth exemplary embodiment. FIG. 11 is a sectional view of a tube-shaped LED lighting device according to the sixth exemplary embodiment.

The following descriptions will be focused on different features of the tube-shaped LED lighting device 600 according to the sixth exemplary embodiment from the tube-shaped LED lighting device of FIG. 4. As such, repeated descriptions to substantially the same elements will be omitted to avoid redundancy.

According to the illustrated exemplary the embodiment, one end 211 and the other end of a substrate 210 are placed inside bases 250. However, in some implementations, only one end of the substrate 210 may be placed inside the base 250 as in the other exemplary embodiments. The one end 211 of the substrate 210 is formed with power pad 280.

In addition, the tube-shaped LED lighting device 600 includes a connector 690. The connector 690 may be formed with conductive patterns. For example, the entirety of both surfaces of the connector 690 may be formed of a conductive material. In this case, one surface of the connector 690 is electrically insulated from the other surface thereof. Alternatively, conductive patterns may be formed on portions of both surfaces of the connector 690 and on the interior of the connector 690. The conductive patterns formed on portions of both surfaces of the connector 690 may be formed on opposite ends of the connector 690, respectively.

One end of the connector 690 contacts the power pad 280 of the substrate 210. Here, the conductive patterns of the connector 690 that are electrically connected to the first power pad 281 and the second power pad 282 are insulated from each other. The other end of the connector 690 is exposed outside the base 250. The other end of the connector 690 exposed outside the base 250 is connected to an external power device. As such, the substrate 210 is electrically connected to the external power device through the connector 690.

Figure 12:
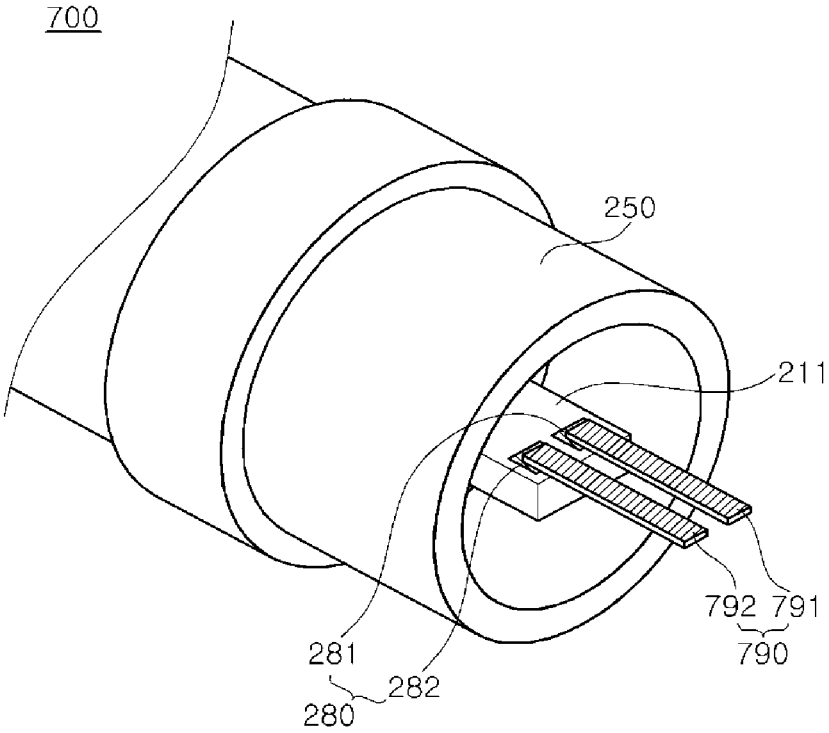
FIG. 12 is a sectional view of a tube-shaped LED lighting device according to a seventh exemplary embodiment.
Figure 13:
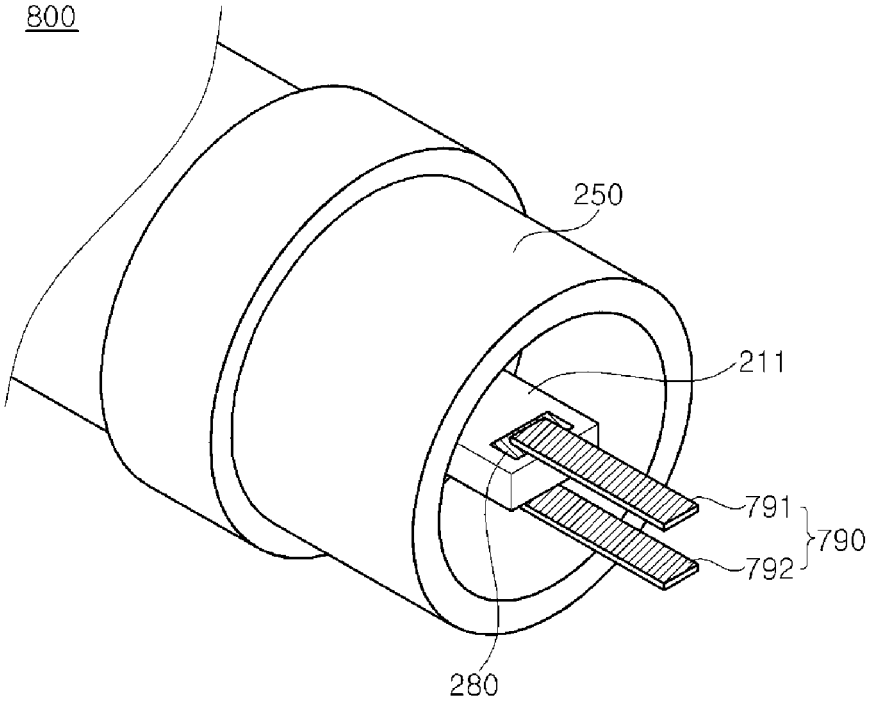
FIG. 13 is a sectional view of a tube-shaped LED lighting device according to an eighth exemplary embodiment.
Figure 14:
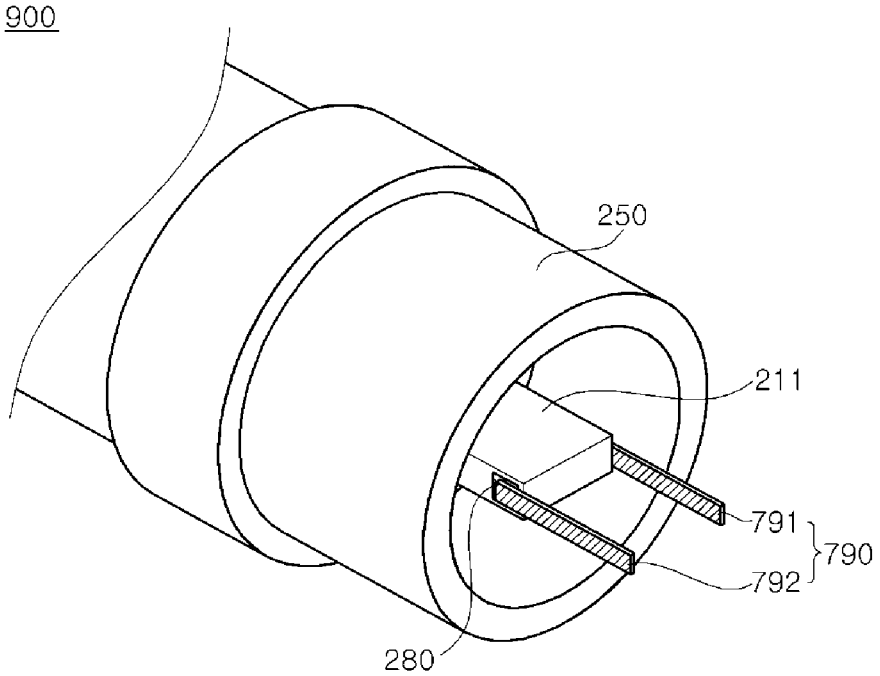
FIG. 14 is a sectional view of a tube-shaped LED lighting device according to a ninth exemplary embodiment.

FIG. 12 to FIG. 14 illustrates tube-shaped LED lighting devices according to seventh to ninth exemplary embodiments.

The following descriptions will be focused on different features of tube-shaped LED lighting devices 700, 800, 900 according to the seventh to ninth exemplary embodiments from the tube-shaped LED lighting device of FIG. 11. As such, repeated descriptions of the substantially the same elements will be omitted.

FIG. 12 is a sectional view of a tube-shaped LED lighting device according to a seventh exemplary embodiment.

Referring to FIG. 12, the tube-shaped LED lighting device 700 according to the seventh exemplary embodiment includes a first power pad 281 and a second power pad 282 formed on one surface of the substrate 210. In addition, a connector 790 includes a first connector 791 and a second connector 792. The first connector 791 may contact the first power pad 281 to be electrically connected thereto. In addition, the second connector 792 may contact with the second power pad 282 to be electrically connected thereto. For example, the first connector 791 and the second connector 792 may be formed of a conductive material. Alternatively, the first connector 791 and the second connector 792 may be formed with conductive patterns for electrical connection between the substrate 210 and an external power device.

FIG. 13 is a sectional view of a tube-shaped LED lighting device according to an eighth exemplary embodiment.

Referring to FIG. 13, the tube-shaped LED lighting device 800 according to the eighth exemplary embodiment includes power pad 280 formed on both surfaces of the substrate 210. For example, a first power pad is formed on one surface of the substrate 210 and a second power pad is formed on the other surface thereof. A first connector 791 contacts the first power pad to be electrically connected thereto. In addition, the second connector 792 contacts the second power pad to be electrically connected thereto. For example, the first connector 791 and the second connector 792 may be formed of a conductive material. Alternatively, the first connector 791 and the second connector 792 may partially be formed with conductive patterns for electrical connection between the substrate 210 and an external power device.

FIG. 14 is a sectional view of the tube-shaped LED lighting device according to the ninth exemplary embodiment.

Referring to FIG. 14, the tube-shaped LED lighting device 900 according to the ninth exemplary embodiment includes power pad 280 formed on opposite side surfaces of the substrate 210. For example, a first power pad is formed on one side surface of the substrate 210 and a second power pad is formed on the other side surface thereof. A first connector 791 contacts the first power pad to be electrically connected thereto. In addition, the second connector 792 contacts the second power pad to be electrically connected thereto. For example, the first connector 791 and the second connector 792 may be formed of a conductive material. Alternatively, the first connector 791 and the second connector 792 may partially be formed with conductive patterns for electrical connection between the substrate 210 and an external power device.

As described above, the power pad may have various structures and may be disposed at various locations on one end of the substrate disposed inside the base. As such, the connector may also have various structures and may be disposed at various locations.

Figure 15:
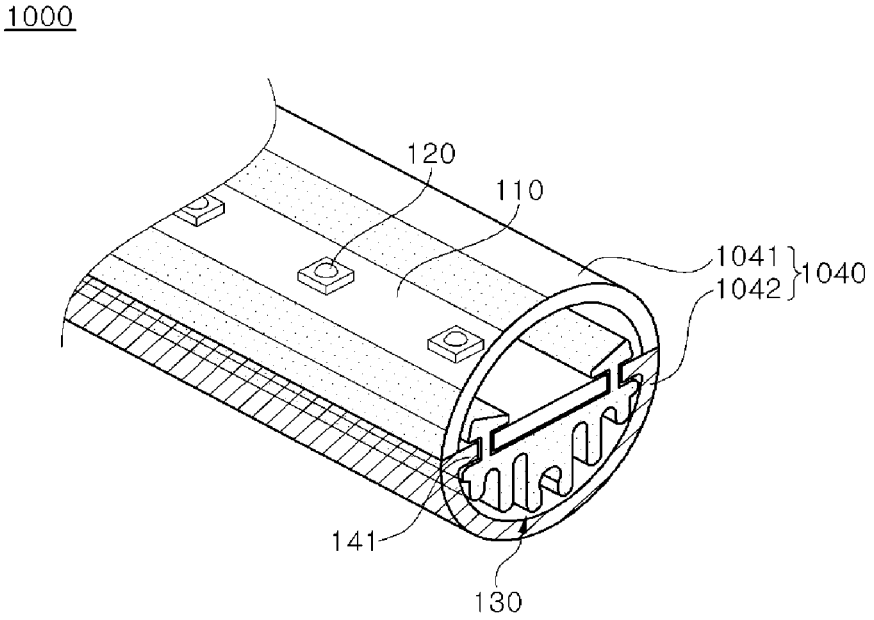
FIG. 15 is a sectional view of a tube-shaped LED lighting device according to a tenth exemplary embodiment.

FIG. 15 is a sectional view of a tube-shaped LED lighting device according to a tenth exemplary embodiment.

According to the first to ninth embodiments, the cover 140 (see FIG. 1 to FIG. 14) of the lighting device is illustrated as being formed of a transparent material. However, the inventive concepts are not limited thereto.

Referring to FIG. 15, the tube-shaped LED lighting device 1000 includes a cover 1040 formed of a mixture of a transparent material and a non-transparent material.

The cover 1040 is divided into a first cover 1041 and a second cover 1042.

Referring to FIG. 15, the first cover 1041 is a portion of the cover 1040 disposed above the overhang 141. More particularly, the first cover 1041 includes a portion through which light emitted from the light emitting device 120 passes. The first cover 1041 is formed of a transparent material. For example, the first cover 1041 is formed of pure PMMA.

Referring again to FIG. 15, the second cover 1042 includes the overhang 141 of the cover 1040 and a portion disposed under the overhang 141. More particularly, the second cover 1042 is a portion of the cover 1040 excluding the first cover 1041. The second cover 1042 is formed of a non-transparent material.

In the illustrated exemplary embodiment, the first cover 1041 and the second cover 1042 are divided with reference to the overhang 141. However, the inventive concepts are not limited thereto. For example, the reference for separating the first cover 1041 from the second cover 1042 may be variously modified, so long as the first cover 1041 transmits light emitted from the light emitting device 120 therethrough.

Coupling of the first cover 1041 and the second cover 1042 may be achieved by any method known in the art. Alternatively, the first cover 1041 may be integrally formed with the second cover 1042, and the portion of the cover 1040 corresponding to the second cover 1042 may be coated with a non-transparent material.

Figure 16:
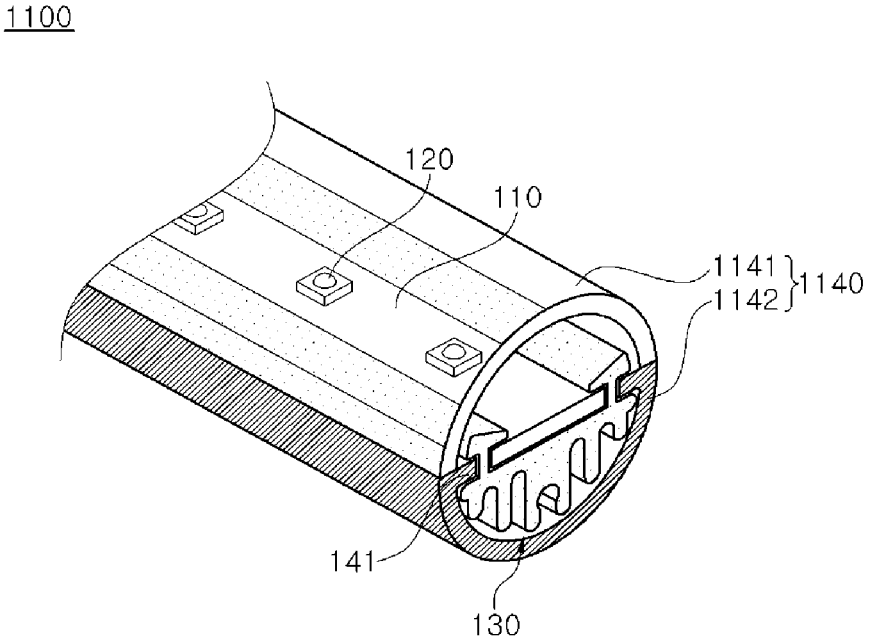
FIG. 16 is a sectional view of a tube-shaped LED lighting device according to an eleventh exemplary embodiment.

FIG. 16 is a sectional view of a tube-shaped LED lighting device according to an eleventh exemplary embodiment.

According to the first to ninth embodiments, the cover 140 (see FIG. 1 to FIG. 14) of the LED lighting device is illustrated as being a transparent cover, a translucent cover, or a colored cover. However, the inventive concepts are not limited thereto, the cover 140 including only one of the transparent cover, the translucent cover, and the colored cover.

Referring to FIG. 16, the cover 1140 may have a mixture of two or more of a transparent region, a translucent region, and a colored region.

The cover 1140 is divided into a first cover 1141 and a second cover 1142.

Referring to FIG. 16, the first cover 1141 is a portion of the cover 1140 disposed above the overhang 141. The second cover 1142 is a portion of the cover 1140 excluding the first cover 1141.

According to the illustrated exemplary embodiment, the first cover 1141 is transparent and the second cover 1142 is translucent or colored. However, the inventive concepts are not limited thereto. For example, the first cover 1141 may be translucent or colored and the second cover 1142 may be transparent. Alternatively, the first cover 1141 may be translucent and the second cover 1142 may be colored. Still alternatively, the first cover 1141 may be colored and the second cover 1142 may be translucent. Such a translucent cover or colored cover 1140 may be formed by coating the first transparent cover 1141 and second transparent cover 1142 with a translucent material or colored material. Alternatively, the translucent or colored cover 1140 may be formed by including a translucent or colored materials.

In the illustrated exemplary embodiment, the first cover 1141 and the second cover 1142 are divided with reference to the overhang 141. However, the inventive concepts are not limited thereto. For example, the reference for separating the first cover 1141 from the second cover 1142 may be variously modified.

In the illustrated exemplary embodiment, the first cover 1141 and the second cover 1142 are divided from each other with reference to a color. However, the inventive concepts are not limited to the first cover 1141 from being physically divided from the second cover 1142. For example, in some exemplary embodiments, the first cover 1141 may be integrally formed with the second cover 1142. In addition, the cover 1140 may be coated with a translucent material and a colored material on a predetermined portion thereof. Furthermore, in some exemplary embodiments, the cover 1140 may have a mixed color of two or more colors. The cover 1140 may include two and more colored regions of different colors In an exemplary embodiment, the cover 1040 according to the tenth exemplary embodiment (see FIG. 15) and the cover 1140 according to the eleventh exemplary embodiment (see FIG. 16) may be combined. In particular, each of the first cover 1041 (see FIG. 15), which is transparent, and the second cover 1042, which is non-transparent, (see FIG. 15) may include at least one of a transparent region, a translucent region, and a colored region.

Figure 17:
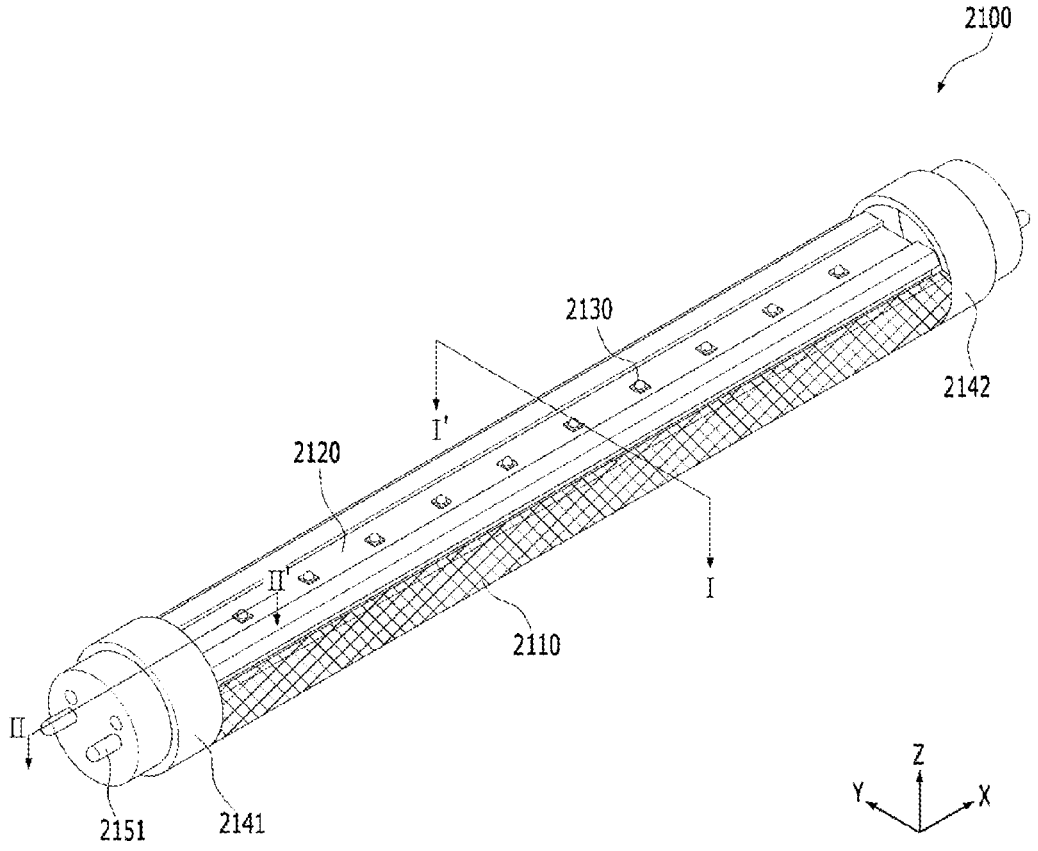
FIG. 17 is a schematic view of a UV lamp according to an exemplary embodiment.
Figure 18:
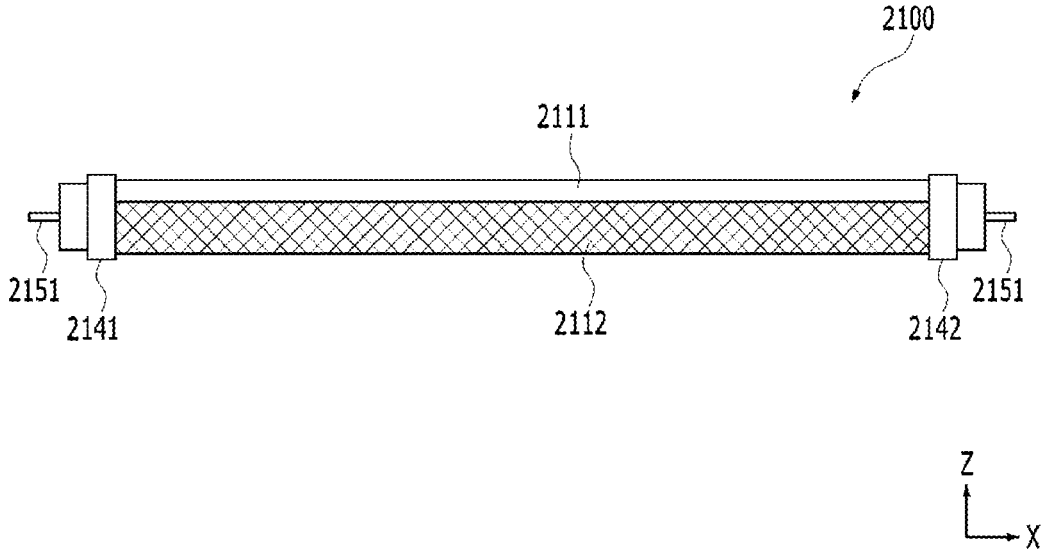
FIG. 18 is a schematic cross-sectional view of the UV lamp of FIG. 17.

FIG. 17 is a schematic view of a UV lamp 2100 according to an exemplary embodiment. FIG. 18 is a side view of the UV lamp 2100 shown in FIG. 17.

Referring to FIG. 17, the UV lamp 2100 includes a lamp tube 2110, a printed circuit board 2120, at least one UV light emitting device 2130, bases 2141, 2142, and at least one power pin 2151.

The lamp tube 2110 includes an upper cover and a lower cover integrally formed with the upper cover. The lamp tube 2110 substantially extends in the X direction and defines an interior space of the UV lamp 2100. The lamp tube 2110 has a height substantially in the Z direction. The lamp tube 2110 may substantially have a cylindrical shape, as shown in FIG. 17.

Referring to FIG. 18, the upper cover 2111 is formed of a transparent material. According to an exemplary embodiment, the upper cover 2111 includes polymethyl methacrylate (PMMA) and/or quartz. The lower cover 2112 may be formed of an opaque material in order to shield a space corresponding to the lower cover inside the lamp tube 2110. The lower cover 2112 may include polymethyl methacrylate and/or quartz. In one exemplary embodiment, the lower cover 2112 may further include at least one of a pigment, a filler, or the like.

Referring back to FIG. 17, the printed circuit board 2120 extends substantially in the X direction and has a width in the Y direction. The printed circuit board 2120 is secured inside the lamp tube 2110. The printed circuit board 2120 drives at least one UV light emitting device 2130 with power received through the power pin 2151.

The at least one UV light emitting device 2130 is disposed on the printed circuit board 2120. FIG. 17 exemplarily illustrates ten UV light emitting devices arranged on the printed circuit board 2120 in the X direction. The UV light emitting device 2130 is disposed to face the upper cover 2111. The UV light emitting device 2130 is adapted to emit UV light under control of the printed circuit board 2120. The UV light emitting device 2130 may be secured such that UV light emitted therefrom is directed toward the transparent upper cover. In one exemplary embodiment, the UV light emitting device 2130 may be a UV LED.

The bases 2141, 2142 are secured to opposite distal ends of the lamp tube 2110. The bases 2141, 2142 may block the interior of the lamp tube 2110 from the exterior. At least one power pin 2151 is secured to the bases 2141, 2142. The power pin 2151 is connected to an external connector to receive power for operation of the printed circuit board 2120. In one exemplary embodiment, when DC power is supplied through the external connector, the printed circuit board 2120 may receive DC power through the power pin 2151. In another exemplary embodiment, when AC power is supplied through the external connector, the UV lamp 2100 may further include a power supply adapted to convert AC power received through the power pin 2151 into DC power. The power supply supplies the converted DC power to the printed circuit board 2120.

In an exemplary embodiment, the bases 2141, 2142 may include polycarbonate (PC).

Figure 19:
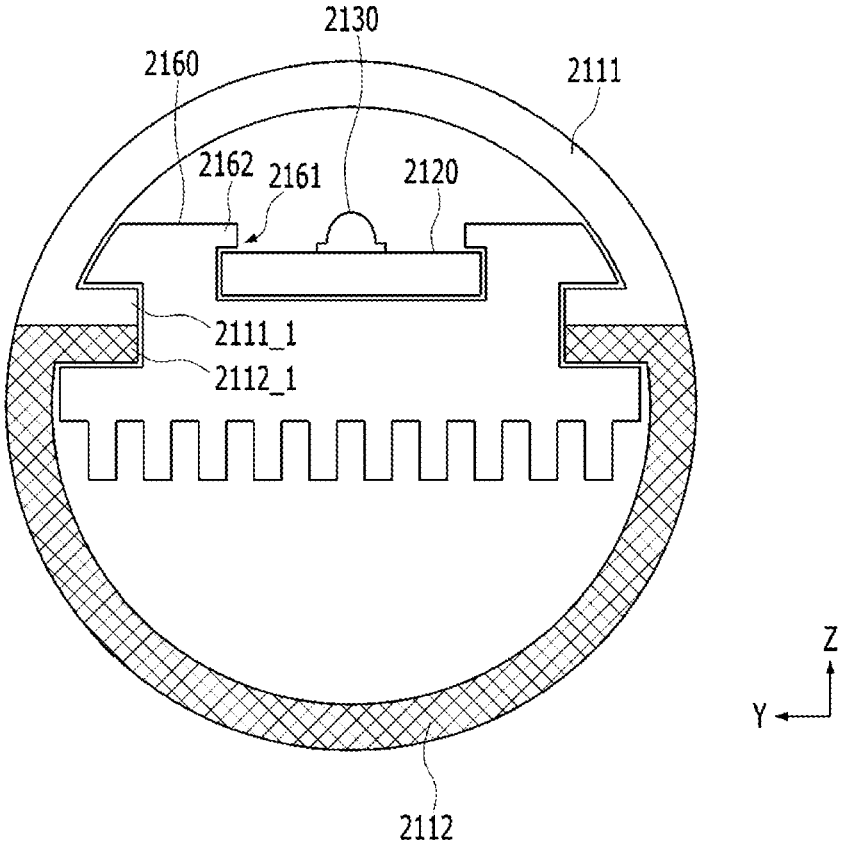
FIG. 19 is a cross-sectional view taken along line I-I' of the UV lamp of FIG. 17.

FIG. 19 is a cross-sectional view of the UV lamp 2100 taken along line I-I' of FIG. 17.

Referring to FIG. 19, the UV lamp 2100 further includes a heat sink 2160. The heat sink 2160 is adapted to dissipate heat generated from the printed circuit board 2120 upon operation of the printed circuit board 2120. For example, the heat sink 2160 may include a plurality of concavo-convex shapes formed on a lower surface thereof, as shown in FIG. 19. The plurality of concavo-convex shapes increases a surface area of the lower surface of the heat sink 2160, to increase heat dissipation efficiency.

The heat sink 2160 is secured to the lamp tube 2110. For example, the upper cover 2111 and the lower cover 2112 include an overhang 2111_1 and an overhang 2112_1 protruding into the interior space of the UV lamp 2110, and the heat sink 2160 may be secured by the overhangs 2111_1, 2112_1.

The heat sink 2160 may have a groove 2161 formed on an upper surface thereof. When the printed circuit board 2120 is placed in the groove 2161, the heat sink 2160 can support the printed circuit board 2120. The heat sink 2160 may include at least one protrusion 2162 protruding from an upper portion of the groove 2161 substantially in the Y direction or in an opposite direction to the Y direction. The protrusion 2162 allows the printed circuit board 2120 to be effectively secured to the heat sink 2160.

Figure 20A:
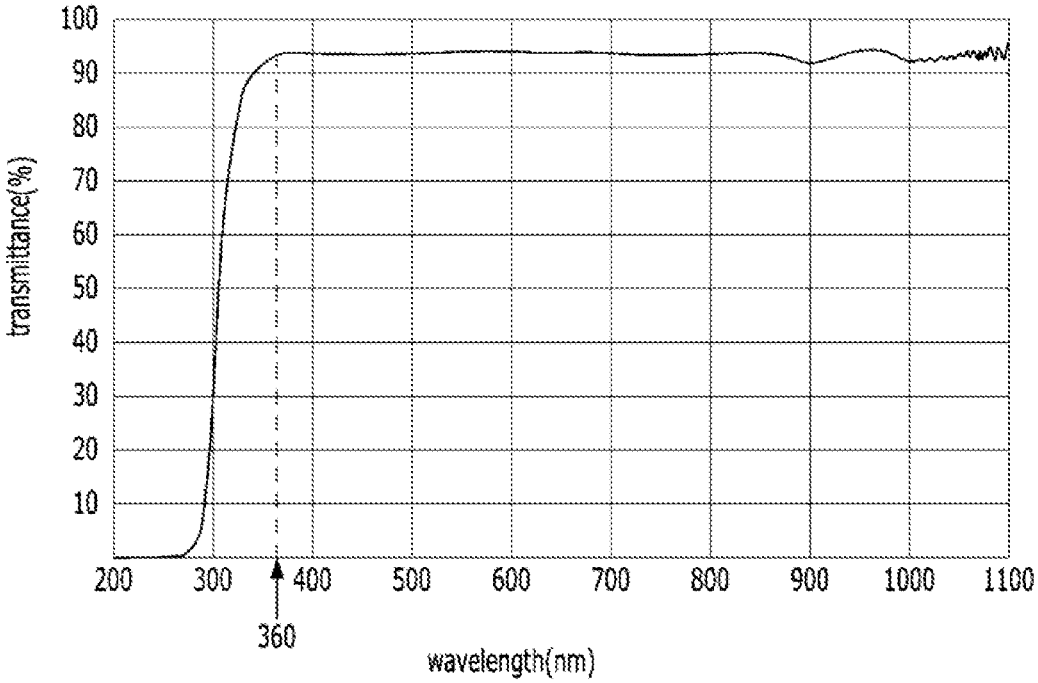
FIG. 20A is a graph depicting variation in transmittance of an upper cover according to an exemplary embodiment.

FIG. 20A is a graph depicting variation in transmittance of the upper cover 2111 according to an exemplary embodiment. In FIG. 20A, the horizontal axis indicates wavelengths in nanometers (nm) and the vertical axis indicates transmittance.

Referring to FIG. 20A, the upper cover 2111 including polymethyl methacrylate has a transmittance of 0% at a wavelength of 200 nm. The transmittance of the upper cover 2111 sharply increases at about 300 nm. The transmittance of the upper cover 2111 is 90% or greater at a wavelength of about 340 nm and is stably maintained at a value greater than 90% at a wavelength of 360 nm or more. For example, the transmittance of the upper cover 2111 is greater than 90% at wavelengths of 400 nm, 500 nm, 600 nm, 700 nm, 800 nm, 900 nm, 1000 nm, and 1100 nm. From this result, it can be understood that polymethyl methacrylate has a critical significance at a wavelength of about 360 nm.

According to the exemplary embodiments, the UV light emitting device 2130 emits UV light having a wavelength of 360 nm or more toward the upper cover 2111, and the upper cover 2111 includes polymethyl methacrylate. In this manner, the upper cover 2111 allows the UV light to pass therethrough with high transmittance.

UV light generally has a wavelength of about 100 nm to 400 nm. The UV light emitting device 2130 may emit UV light having a predetermined wavelength in the wavelength range of 360 nm to 400 nm.

The polymethyl methacrylate may be deformed at a relatively low temperature. When UV light having a wavelength of 360 nm or more passes through the upper cover 2111 including polymethyl methacrylate, the upper cover 2111 may be deformed from heat.

Figure 20B:
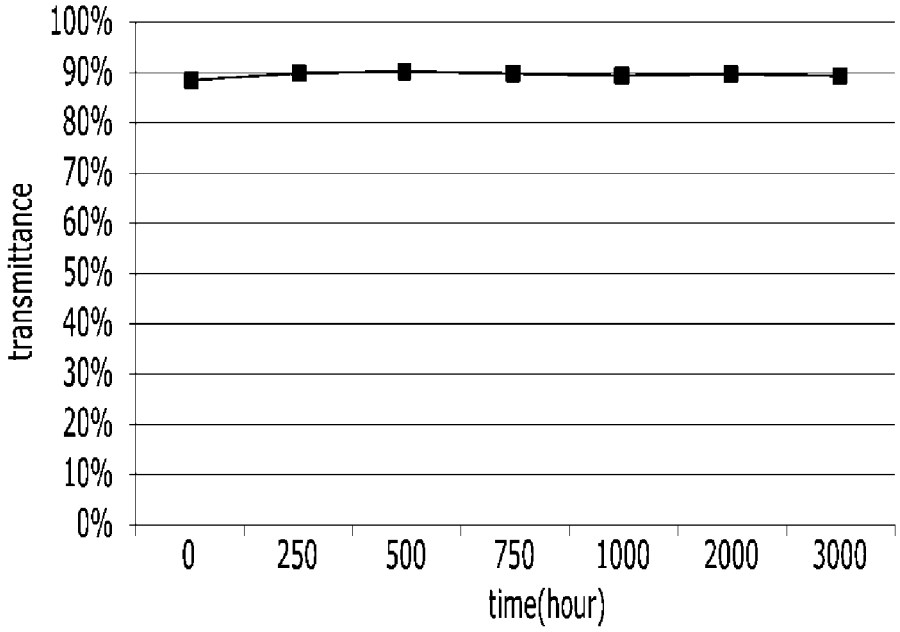
FIG. 20B is a graph depicting time-dependent variation in transmittance of the upper cover according to an exemplary embodiment.
Figure 21:
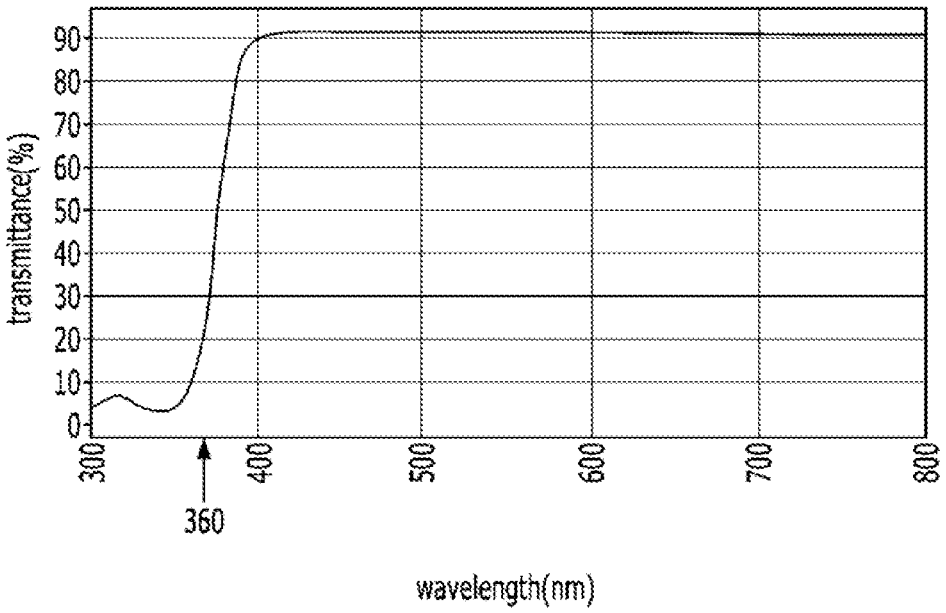
FIG. 21 is a graph depicting variation in transmittance of the upper cover according to an exemplary embodiment.

FIG. 20B is a graph depicting time-dependent variation in transmittance of the upper cover 2111 according to an exemplary embodiment. FIG. 21 is a graph depicting variation in transmittance of the upper cover 2111 containing a diffusion agent according to wavelength of light. In FIG. 20B the horizontal axis indicates time and the transverse axis indicates transmittance. In FIG. 21, the horizontal axis indicates wavelength and the transverse axis indicates transmittance.

Referring to FIG. 20B, despite an increase of an exposure time of the upper cover 2111 including polymethyl methacrylate to UV light having a wavelength of 360 nm, the transmittance of the upper cover 2111 is maintained at about 90%. For example, when the exposure time of the upper cover 2111 to UV light is 0, 250 hours, 500 hours, 750 hours, 1,000 hours, 2,000 hours, and 3,000 hours, the transmittance of the upper cover 2111 is about 90%. The transmittance of the upper cover 2111 may be changed by about 5% to 10% according to experimental error.

Retention of high transmittance even when the upper cover 2111 is continuously exposed to UV light having a wavelength of 360 nm may mean that the upper cover 2111 is not deformed even by continuous exposure to UV light. For example, even when the upper cover 2111 is continuously exposed to the UV light, the upper cover 2111 does not suffer from discoloration or cracking. This means that the use of UV light cannot easily generate heat from the upper cover 2111. It can be understood that this is because the upper cover 2111 efficiently transmits UV light rather than absorbing UV light. Accordingly, despite the properties of polymethyl methacrylate that can be deformed at a relatively low temperature, the upper cover 2111 including polymethyl methacrylate according to an exemplary embodiment is prevented from being deformed by the provision of the UV light emitting device adapted to emit UV light having a wavelength of 360 nm or more.

As such, the upper cover 2111 allows UV light having a wavelength of 360 nm or more to pass therethrough with high transmittance without being deformed even if exposed to UV light for a long time.

In an exemplary embodiment, the upper cover 2111 may be free from a diffusion agent for light diffusion or may contain a small amount of the diffusion agent. The diffusion agent may be contained in the tube of the lamp emitting visible light. The diffusion agent improves uniformity of visible light through diffusion of visible light passing through the tube. Assuming that the upper cover 2111 includes the diffusion agent, UV light having a wavelength of 360 nm or more is absorbed and scattered by the diffusion agent, thereby reducing transmittance of the upper cover 2111. Referring to FIG. 21, the upper cover 2111 has a transmittance of less than 10% at 360 nm, and a transmittance of 90% at 400 nm or more. This means that the upper cover 2111 including the diffusion agent has high transmittance with respect to visible light, and low transmittance with respect to UV light having a wavelength of 360 nm to 400 nm. According to the illustrated exemplary embodiment, the upper cover 2111 may be free from the diffusion agent or may contain a small amount of the diffusion agent. Accordingly, as described with reference to FIG. 20B, the upper cover 2111 can maintain high transmittance with respect to UV light having a wavelength of 360 nm or more. Furthermore, the upper cover 2111 may not absorb and refract UV light by the diffusion agent, thereby reducing or preventing deformation of the upper cover 2111 by heat.

In an exemplary embodiment, the upper cover 2111 may be free from an impact reinforcing agent or may contain a small amount of the impact reinforcing agent, for example, acrylic rubbers. As described with reference to FIG. 20B, the upper cover 2111 can maintain high transmittance with respect to UV light having a wavelength of 360 nm or more without absorption of UV light by the impact reinforcing agent.

For example, the upper cover 2111 may include pure polymethyl methacrylate.

Figure 22:
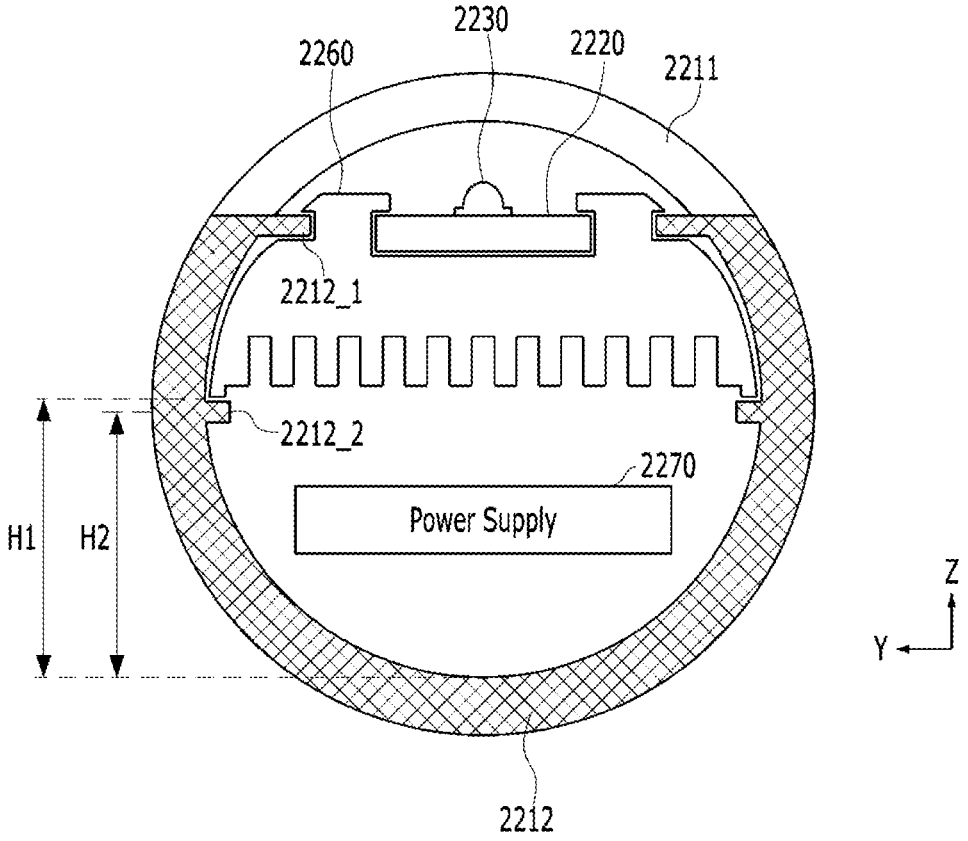
FIG. 22 is a cross-sectional view of a UV lamp according to an exemplary embodiment.

FIG. 22 is a cross-sectional view of a UV lamp 2100 according to another exemplary embodiment.

Referring to FIG. 22, a printed circuit board 2220, a UV light emitting device 2230, a heat sink 2260, and a power supply 2270 are disposed inside an upper cover 2211 and a lower cover 2212.

As described with reference to FIG. 20A and FIG. 20B, the upper cover 2211 has high transmittance with respect to UV light having a wavelength of 360 nm without being deformed thereby. Accordingly, the heat sink 2260 may be disposed at a high height H1, such that the distance between the UV light emitting device 2230 and the upper cover 2211 is reduced, as compared with the lamp tube shown in FIG. 19.

The heat sink 2260 may be placed at a location higher than or equal to the height H1 thereof. The height H1 may be greater than a height H2 corresponding to a radius of the lamp tube (2110 of FIG. 17). Accordingly, it is possible to secure a region in which the power supply 2270 is placed between the heat sink 2260 and the lower cover 2212. In this case, the upper cover 2211 may include polymethyl methacrylate and/or quartz, and may be formed to be transparent. Furthermore, the lower cover 2212 may include polymethyl methacrylate and/or quartz, and may be formed to be opaque.

The heat sink 2260 may be secured to the lamp tube in various ways. For example, as shown in FIG. 22, the lower cover 2212 may include first overhang 2212_1 and second overhang 2212_2 protruding toward the interior region of the lamp tube, and the heat sink 2260 may be secured to the first overhang 2212_1 and second overhang 2212_2.

The power supply 2270 is adapted to convert external AC power into DC power and to supply the converted DC power to the printed circuit board 2220. In an exemplary embodiment, the power supply 2270 may be a switched mode power supply (SNIPS).

Figure 23:
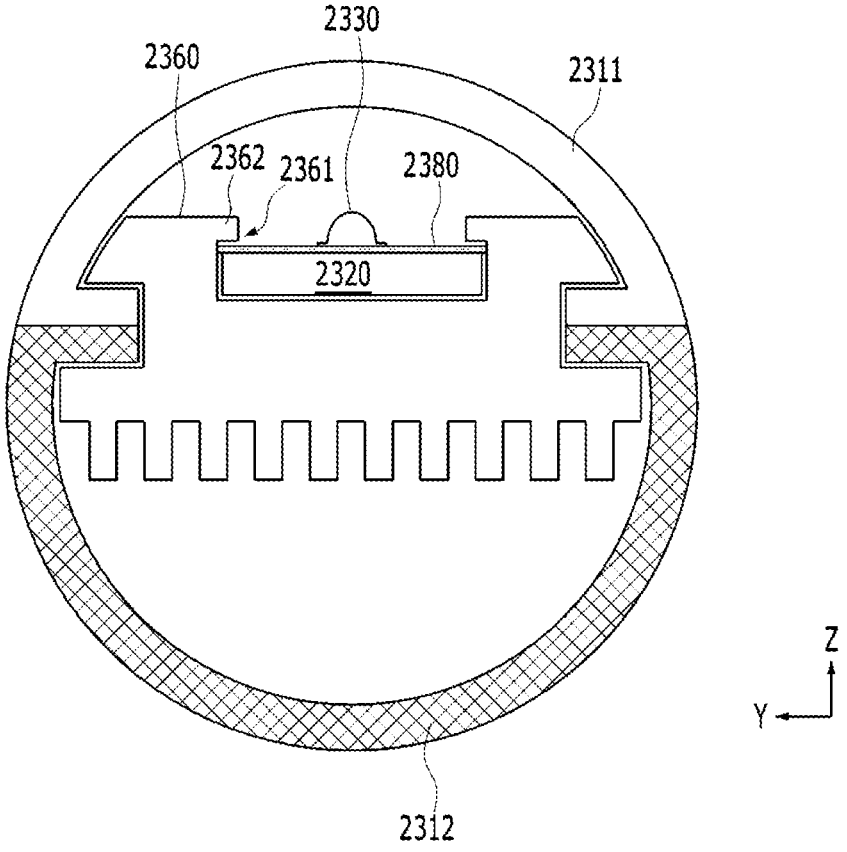
FIG. 23 is a cross-sectional view of a UV lamp according to an exemplary embodiment.
Figure 24:
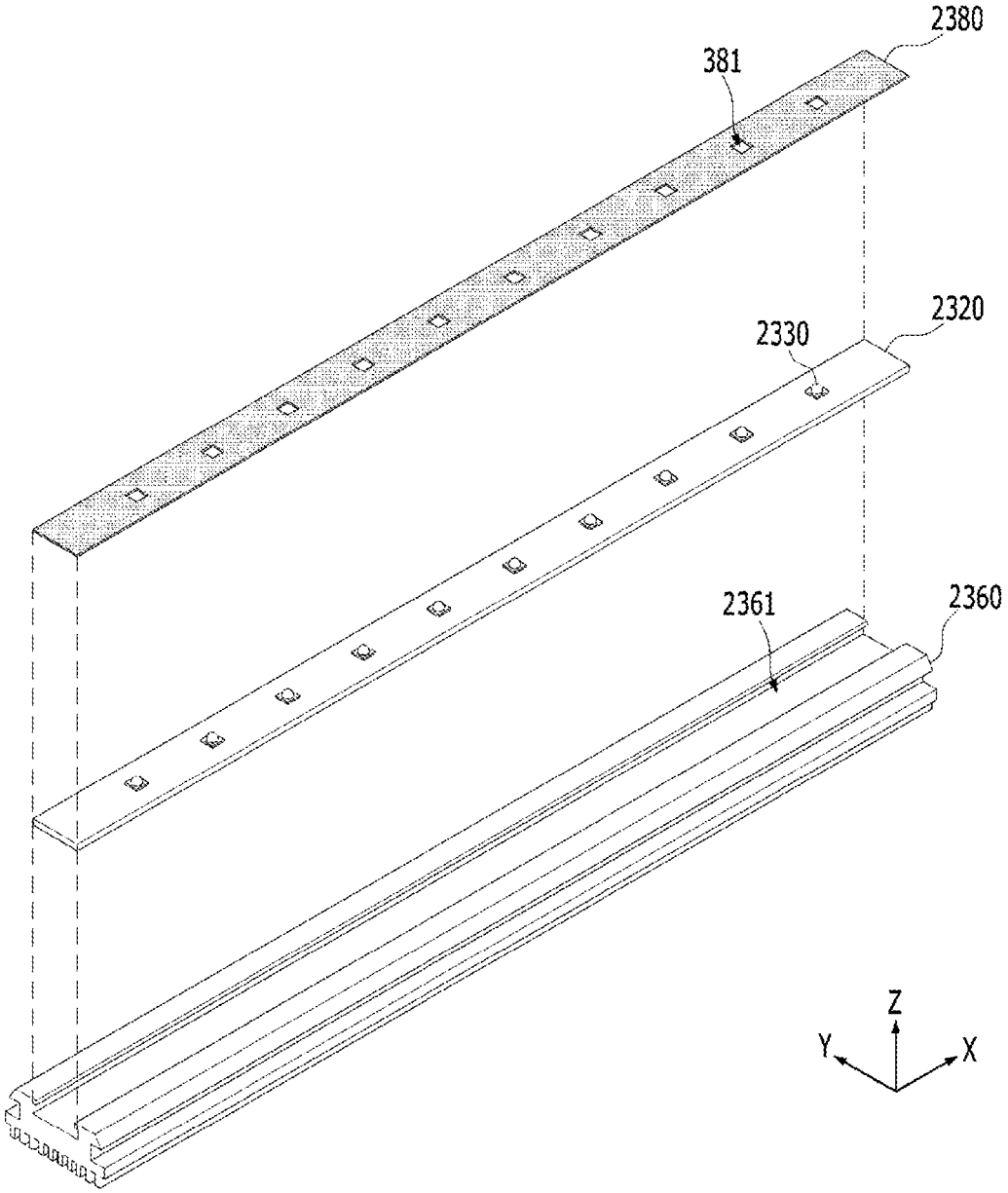
FIG. 24 is an exploded perspective view of a printed circuit board, UV light emitting devices, a heat sink, and a flame retardant layer according to an exemplary embodiment.

FIG. 23 is a cross-sectional view of a UV lamp 2100 according to a further exemplary embodiment. FIG. 24 is an exploded perspective view showing a printed circuit board 2320, UV light emitting devices 2330, a heat sink 2360, and a flame retardant layer 2380.

Referring to FIG. 23, the printed circuit board 2320, the UV light emitting device 2330, the heat sink 2360, and a flame retardant layer 2380 are disposed inside the upper cover 2311 and the lower cover 2312.

As described above, polymethyl methacrylate contained in the upper cover 2311 may be deformed at a relatively low temperature. The printed circuit board 2320 can generate a spark and a flame during operation.

According to an exemplary embodiment, the flame retardant layer 2380 is disposed between the printed circuit board 2320 and the upper cover 2311. The flame retardant layer 2380 may be disposed on the printed circuit board 2320. The flame retardant layer 2380 may include a flame retardant substance. The flame retardant layer 2380 can protect the upper cover 2311 from the spark and flame generated from the printed circuit board 2320.

A groove 2361 may be formed on the heat sink 2360. The heat sink 2360 may include at least one protrusion 2362 protruding from an upper portion of the groove 2361 substantially in the Y direction or in an opposite direction to the Y direction. The printed circuit board 2320 and the flame retardant layer 2380 may be received in the groove 2361 and may be secured by the protrusion 2362.

Referring to FIG. 24, the flame retardant layer 2380 includes one or more holes 381. Each of the holes 381 may correspond to each of the UV light emitting devices 2330 on the printed circuit board 2320. When the flame retardant layer 2380 is attached to the printed circuit board 2320, the UV light emitting device 2330 pass through the hole 381. After attachment of the flame retardant layer 2380, the UV light emitting device 2330 protrudes toward the upper cover 2311 through the flame retardant layer 2380. The printed circuit board 2320 and the flame retardant layer 2380 are secured in the groove 2361.

Figure 25:
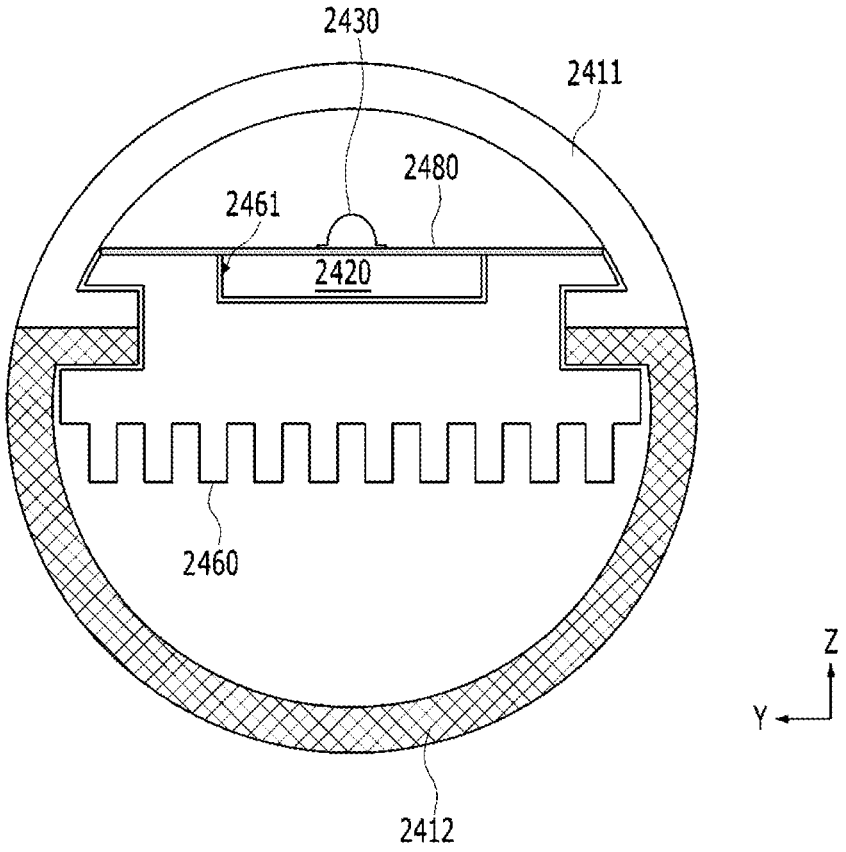
FIG. 25 is a cross-sectional view of a UV lamp according to an exemplary embodiment.

FIG. 25 is a cross-sectional view of a UV lamp 2100 according to a further exemplary embodiment.

Referring to FIG. 25, a printed circuit board 2420, UV light emitting device 2430, a heat sink 2460, and a flame retardant layer 2480 are disposed inside an upper cover 2411 and a lower cover 2412.

The printed circuit board 2420 is disposed in a groove 2461 formed on the heat sink 2460. The flame retardant layer 2480 may be provided to cover an upper side of the heat sink 2460 and the printed circuit board 2420. For example, the flame retardant layer 2480 may be secured to the upper side of the heat sink 2460 and the printed circuit board 2420 using adhesives, for example.

Figure 26:
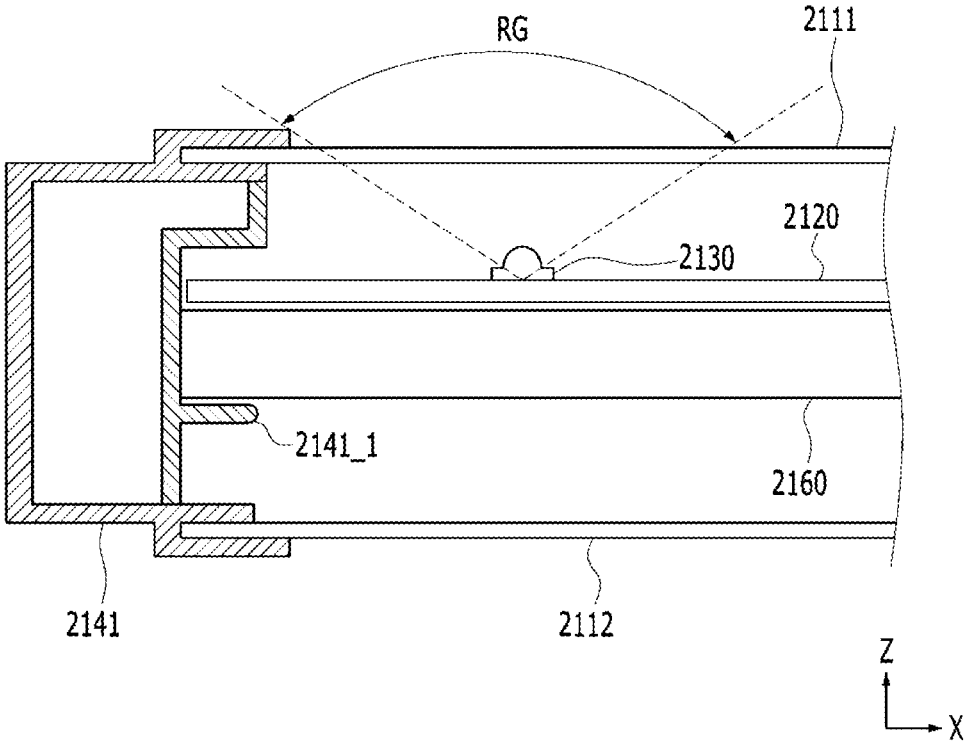
FIG. 26 is a cross-sectional view taken along line III-II' of the UV lamp of FIG. 17.

FIG. 26 is a cross-sectional view taken along line II-II' of the UV lamp of FIG. 17.

Referring to FIG. 26, the printed circuit board 2120, the UV light emitting device 2130, and the heat sink 2160 are disposed inside the upper cover 2111 and the lower cover 2112. The base 2141 is secured to one end of the lamp tube (2110 of FIG. 17). As shown in FIG. 26, the base 2141 may include grooves to receive the upper cover 2111 and the lower cover 2112. The base 2141 may include a support 2141_1 substantially protruding in the X direction to support the heat sink 2160.

The UV light emitting device 2130 may have a predetermined beam range RG. For example, the UV light emitting device 2130 may emit UV light within a beam angle of 120°. According to the illustrated exemplary embodiment, the UV light emitting device 2130 may be disposed such that the base 2141 is placed outside the beam range RG. The UV light emitting device 2130 may be separated from the base 2141 such that the base 2141 is placed outside the beam range RG.

In an exemplary embodiment, the base 2141 may include a UV stabilizer. The UV stabilizer serves to maintain the properties of the base 2141 in a stable state even when the base 2141 is irradiated with UV light. For example, the UV stabilizer may include at least one of an absorbent, a quencher, a hindered amine light stabilizer (HALS), or the like.

Figure 27:
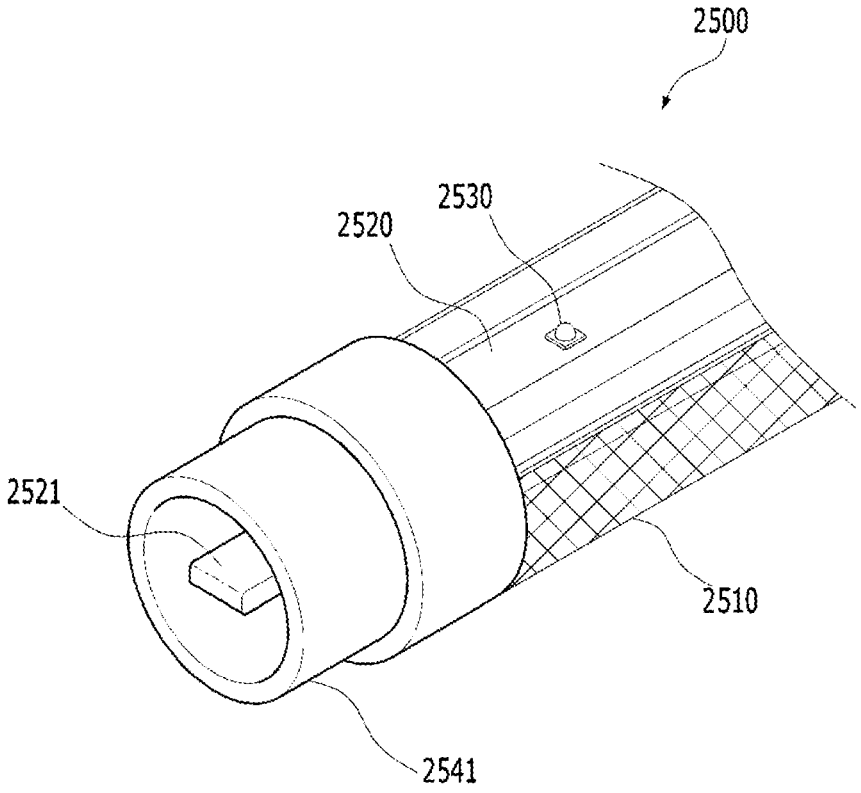
FIG. 27 is a sectional view of a UV lamp according to an exemplary embodiment.
Figure 28:
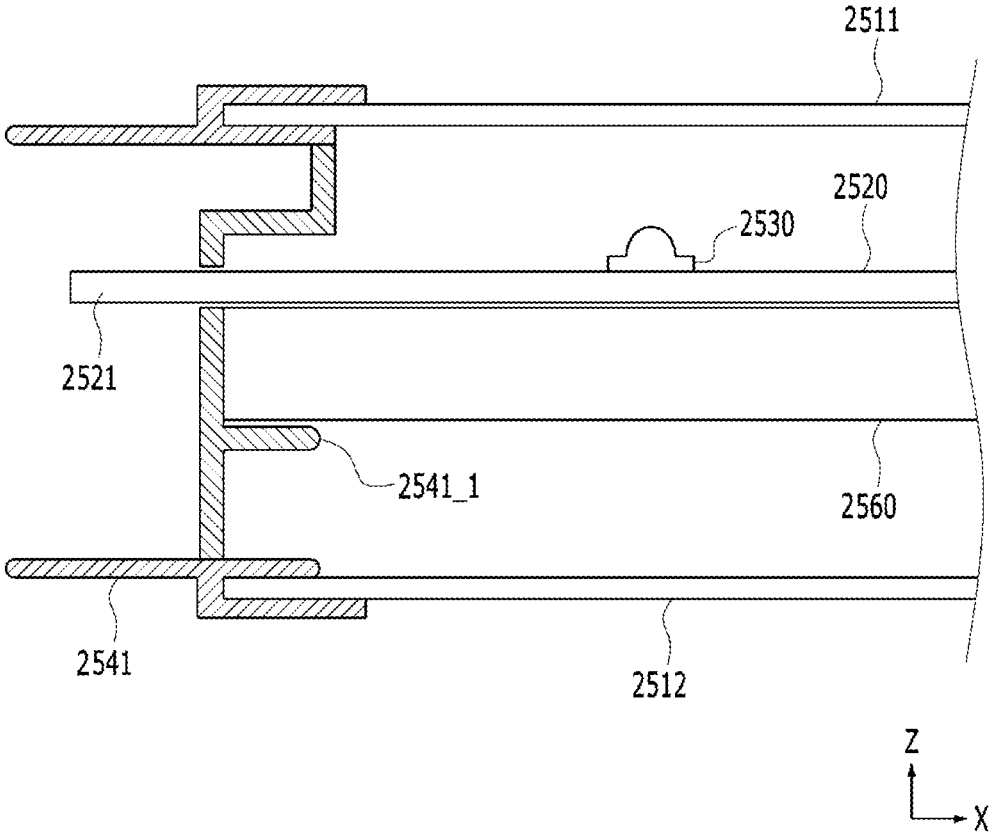
FIG. 28 is a cross-sectional view of the UV lamp of FIG. 27.

FIG. 27 is a sectional view of a UV lamp 2500 according to an exemplary embodiment. FIG. 28 is a cross-sectional view of the UV lamp 2500 shown in FIG. 27. For convenience of description, a portion of the UV lamp 2500 is shown in FIG. 27 and FIG. 28.

Referring to FIG. 27 and FIG. 28, the lamp tube 2510 includes an upper cover 2511 and a lower cover 2512. The upper cover 2511 and the lower cover 2512 have substantially the same configurations as the upper cover 2111 and the lower cover 2112 described with reference to FIG. 17 and FIG. 18. As such, repeated descriptions of substantially the same components will be omitted to avoid redundancy.

A base 2541 is secured to a distal end of the lamp tube 2510. The base 2541 may include a support 2541_1 adapted to support a heat sink 2560.

The UV light emitting device 2530 is disposed on the printed circuit board 2520. The printed circuit board 2520 is disposed on the heat sink 2560 and may include a protrusion 2521 protruding therefrom to extend into an interior space of the lamp tube 2510 and penetrating the base 2541. The protrusion 2521 may be configured to receive an external connector through which power is supplied to the UV lamp 2500. The UV lamp 2500 may receive power through the protrusion 2521.

When an external connector supplies DC power, the printed circuit board 2520 may receive the DC power through the protrusion 2521. When an external connector supplies AC power, the UV lamp 2500 may further include a power supply (2270 of FIG. 22) adapted to convert the AC power received through the protrusion 2521 into DC power. The power supply supplies the converted DC power to the printed circuit board 2520.

Figure 29:
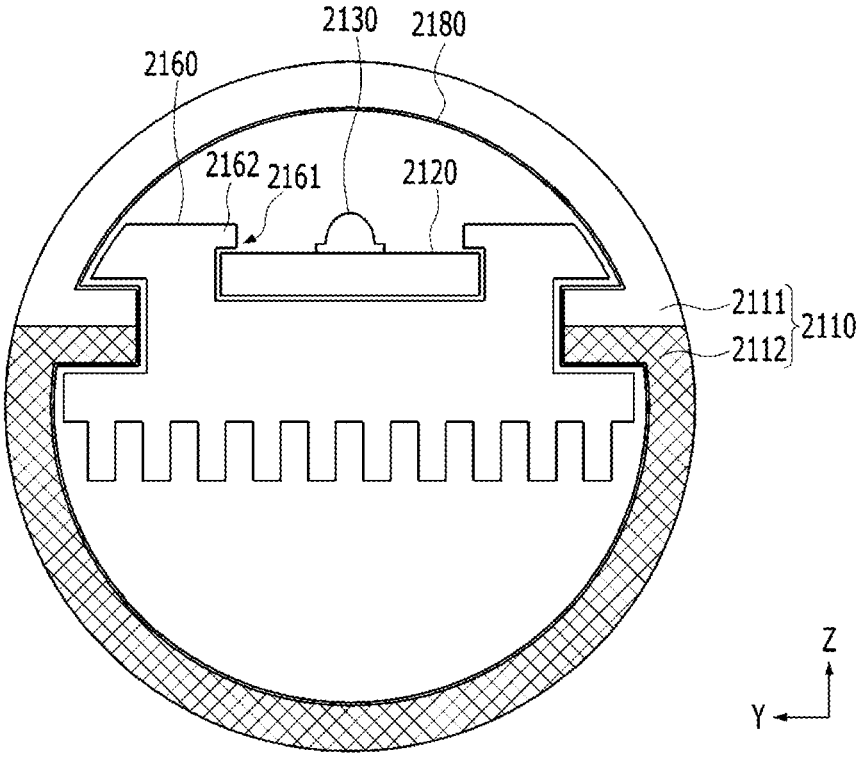
FIG. 29 is a cross-sectional view of a UV lamp according to an exemplary embodiment.

FIG. 29 is a cross-sectional view of a UV lamp 2100 according to yet another exemplary embodiment.

Referring to FIG. 29, the UV lamp 2100 further includes a flame retardant layer 2180. The flame retardant layer 2180 is disposed on an inner surface of the lamp tube 2110.

The printed circuit board 2120, the UV light emitting device 2130, and/or the heat sink 2160 may generate and/or transfer heat, and the heat may be transferred to the lamp tube 2110. According to the illustrated exemplary embodiment, the lamp tube 2110 further includes the flame retardant layer 2180 attached to at least a portion of the inner surface thereof. Accordingly, the lamp tube 2110 and/or the UV lamp 2100 may be prevented from being deformed or burnt.

In an exemplary embodiment, the flame retardant layer 2180 may be disposed over the entirety of the inner surface of the lamp tube 2110. Alternatively, the flame retardant layer 2180 may be disposed on a portion of the inner surface of the lamp tube 2110.

In an exemplary embodiment, the flame retardant layer 2180 may include fluorine.

Figure 30:
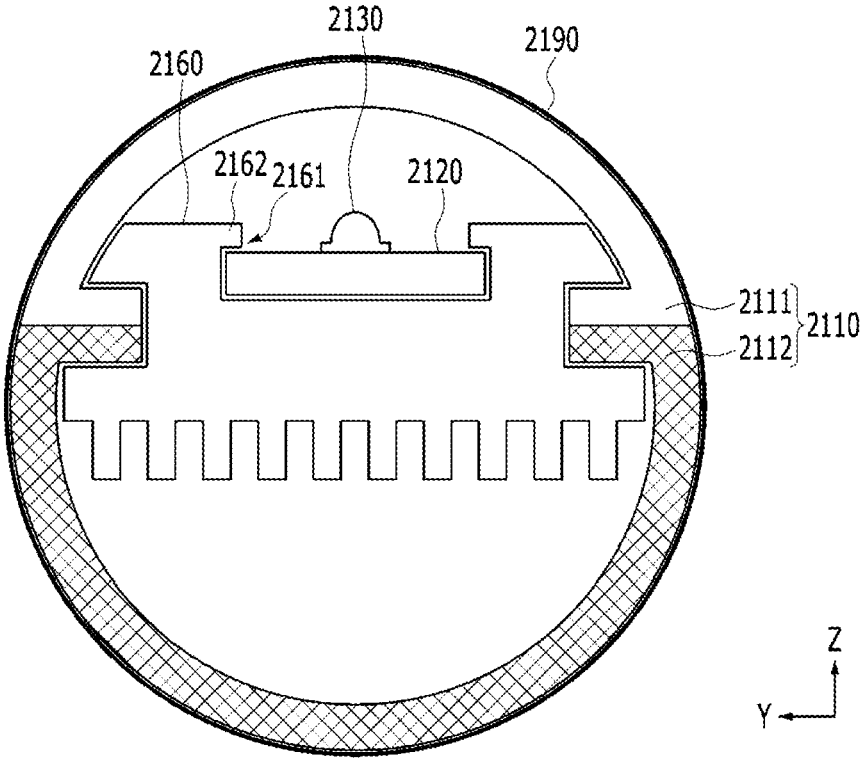
FIG. 30 is a cross-sectional view of the UV lamp according to an exemplary embodiment.

FIG. 30 is a cross-sectional view of the UV lamp 2100 according to yet another exemplary embodiment.

Referring to FIG. 30, the flame retardant layer 2190 may surround at least a portion of an outer surface of the lamp tube 2110. In an exemplary embodiment, the flame retardant layer 2190 may be disposed over the entirety of the outer surface of the lamp tube 2110. Alternatively, the flame retardant layer 2190 may be disposed on a portion of the outer surface of the lamp tube 2110. Accordingly, the lamp tube 2110 and/or the UV lamp 2100 can be prevented from being deformed or burnt. Furthermore, the flame retardant layer 2190 supports the lamp tube 2110 by surrounding the lamp tube 2110, thereby preventing the lamp tube 2110 from being broken and scattered by external impact. For example, such an advantage becomes more apparent when the lamp tube 2110 includes, for example, quartz which can be easily broken.

Figure 31:
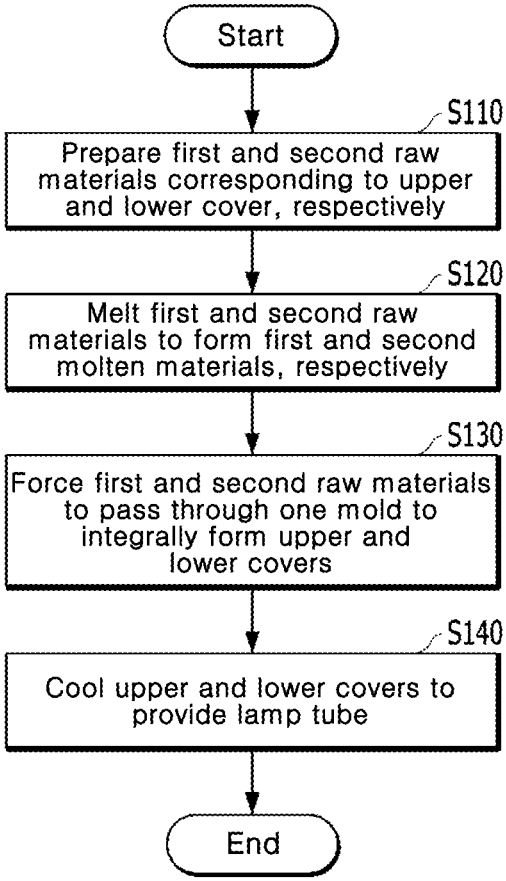
FIG. 31 is a flowchart of a method of manufacturing the lamp tube of FIG. 17 according to an exemplary embodiment.

FIG. 31 is a flowchart of a method of manufacturing the lamp tube 2100 shown in FIG. 17 according to an exemplary embodiment.

Referring to FIG. 31, in S110, a first raw material corresponding to an upper cover (2111 of FIG. 18) and a second raw material corresponding to a lower cover (2112 of FIG. 18) are prepared. For example, the first raw material and the second raw material may be provided to different hoppers, respectively.

The first raw material includes polymethyl methacrylate and/or quartz. In an exemplary embodiment, the first raw material may be free from a diffusion agent for light diffusion or may contain a small amount of the diffusion agent. In an exemplary embodiment, the first raw material may be free from an impact reinforcing agent or may contain a small amount of the impact reinforcing agent.

The second raw material may include polymethyl methacrylate and/or quartz, and materials for imparting a color to the lower cover 2112, for example, a pigment, a filler, or the like.

In S120, the first raw material is melted to form a first molten material and the second raw material is melted to form a second molten material.

For example, the first molten material and the second molten material may be generated in different cylinders, respectively. The corresponding raw materials may be supplied to the cylinders through the corresponding hoppers. In each of the cylinder, the raw material is delivered, melted, and compressed under a suitable pressure to generate the molten material.

In S130, the first molten material and the second molten material are formed to pass through a single mold. For example, the first molten material and the second molten material delivered through different cylinders will pass through a single mold. For example, the upper cover and the lower cover may be molded by a profile extrusion process.

The mold may have one of various shapes. For example, the mold may have a shape corresponding to the upper cover 2111 and the lower cover 2112 shown in FIG. 19. Alternatively, the mold may have a shape corresponding to the upper cover 211 and the lower cover 212 shown in FIG. 22.

According to exemplary embodiments, the first molten material and the second molten material are forced to pass through a single mold, whereby a transparent upper cover 2111 and a translucent lower cover 2112 can be integrally formed with each other.

In S140, the upper cover 2111 and the lower cover 2112 are cooled to provide a lamp tube 2110. For example, the upper cover 2111 and the lower cover 2112 may be cooled by cooling water so as to maintain a molded shape. For example, the lamp tube 2110 may be cut to have a suitable length.

Thereafter, a printed circuit board (2120 of FIG. 19), UV light emitting device (2130 of FIG. 19), and a heat sink (2160 of FIG. 19) are disposed inside the lamp tube 2110.

According to exemplary embodiments, the UV lamp includes UV light emitting device emitting UV light having a wavelength of 360 nm or more toward the upper cover, which includes polymethyl methacrylate. The upper cover may not be deformed when exposed to UV light for a long period of time while allowing the UV light to pass therethrough. Accordingly, a UV lamp according to an exemplary embodiment has an having improved performance and reliability.

According to exemplary embodiments, the tube-shaped LED lighting device has a short distance between the heat sink and the cover, thereby improving heat dissipation. Further, one end of the substrate having the electrode formed thereon is placed inside the base, whereby the tube-shaped LED lighting device can be electrically connected to an external power device without wire bonding. Accordingly, the tube-shaped LED lighting device can be manufactured by a simple process to obviate the process of wire bonding and prevent failure due to open circuit and short circuit that may be caused by wire bonding.

Although some exemplary embodiments have been described herein, it should be understood that these embodiments are provided for illustration only and are not to be construed in any way as limiting the inventive concept of the present disclosure, and that various modifications, changes, alterations, and equivalent embodiments can be made by those skilled in the art.

What is claimed is:

1. An LED lighting device comprising:

a substrate having an elongated shape and an end portion having a width smaller than other portions of the substrate;

a plurality of light emitting devices mounted on the substrate;

power pads disposed on the end portion of the substrate;

a heat sink having one surface on which the substrate is seated, and another surface comprising a groove portion; and a base disposed near the end portion of the substrate, wherein the end portion of the substrate and the power pads are placed inside the base, and wherein the power pads are exposed to an outside to be connected to an external power device.

2. The LED lighting device according to claim 1, wherein the heat sink comprises a substrate holding portion and one surface of the substrate holding portion has a gradually increasing height from an inner side of the heat sink, on which the substrate is seated, toward an outer side thereof.

3. The LED lighting device according to claim 1, wherein:

the base has an opening inside the base; and the end portion of the substrate passes through the opening of the base.

4. The LED lighting device according to claim 1, wherein the power pads are formed on at least one of a first surface and a second surface of the end portion of the substrate.

5. The LED lighting device according to claim 1, further comprising a cover to receive the heat sink, the substrate, and the light emitting device therein, wherein the inner wall of the cover includes a curved surface.

6. The LED lighting device according to claim 5, wherein a first portion of the cover includes a transparent material and a second portion of the cover includes a non-transparent material.

7. The LED lighting device according to claim 5, wherein at least a portion of the cover includes pure polymethyl methacrylate (PMMA).

8. The LED lighting device according to claim 7, wherein light emitted from the light emitting device is configured to pass through the portion of the cover including the pure PMMA.

9. A UV lamp comprising:

a printed circuit board having an elongated shape;

at least one UV light emitting device disposed on the printed circuit board to be operated under control of the printed circuit board;

a heat sink configured to dissipate heat generated from the printed circuit board and having one surface on which the printed circuit board is seated; and a base secured to a distal end of the printed circuit board and having an opening inside the base, wherein the printed circuit board comprises a protruding portion passing through the opening of the base and exposed to an outside to be connected to an external power device.

10. The UV lamp according to claim 9, further comprising:

an upper cover and a lower cover integrally formed with the upper cover; and a flame retardant layer disposed between the printed circuit board and the upper cover or covering at least part of an outer surface of the upper cover, wherein the upper cover comprises polymethyl methacrylate or quartz.

11. The UV lamp according to claim 10, wherein the lower cover comprises polymethyl methacrylate or quartz and is opaque.

12. The UV lamp according to claim 10, wherein:

the heat sink is formed near the upper cover and includes a groove;

the printed circuit board and the flame retardant layer are disposed in the groove; and the flame retardant layer covers the printed circuit board.

13. The UV lamp according to claim 10, wherein:

the heat sink is formed near the upper cover and includes a groove;

the printed circuit board is disposed in the groove; and the flame retardant layer covers the upper side of the heat sink and the printed circuit board.

14. The UV lamp according to claim 10, wherein the flame retardant layer is attached to at least part of an inner surface of the upper cover.

15. The UV lamp according to claim 10, further comprising a power supply disposed between the heat sink and the lower cover and configured to convert external AC power into DC power and to supply the converted DC power to the printed circuit board, wherein the lower cover comprises polymethyl methacrylate or quartz and is opaque.

16. The UV lamp according to claim 9, wherein the at least one UV light emitting device is configured to emit UV light having a wavelength of 360 nm or more.

17. The UV lamp according to claim 9, wherein:

the at least one UV light emitting device is disposed on the printed circuit board and is configured to emit UV light having a first beam orientation range; and the base is disposed outside the first beam orientation range.

18. The UV lamp according to claim 9, wherein the base includes a UV stabilizer.

* * * * *